US007589285B2

(12) United States Patent
Matsumoto et al.

(10) Patent No.: US 7,589,285 B2
(45) Date of Patent: Sep. 15, 2009

(54) MAGNETIC SHIELD PANEL

(75) Inventors: Morihiro Matsumoto, Tokyo (JP); Yuji Okuzaki, Tokyo (JP); Jiroh Mino, Tokyo (JP); Yoneo Yamada, Tokyo (JP); Takeshi Saito, Tokyo (JP); Takubi Hamano, Tokyo (JP)

(73) Assignee: Nippon Steel & Sumikin Coated Sheet Corporation, Tokyo (JP)

( * ) Notice: Subject to any disclaimer, the term of this patent is extended or adjusted under 35 U.S.C. 154(b) by 76 days.

(21) Appl. No.: 10/571,310

(22) PCT Filed: Sep. 10, 2004

(86) PCT No.: PCT/JP2004/013598

§ 371 (c)(1),
(2), (4) Date: Jul. 31, 2006

(87) PCT Pub. No.: WO2005/026462

PCT Pub. Date: Mar. 24, 2005

(65) Prior Publication Data

US 2007/0029110 A1 Feb. 8, 2007

(30) Foreign Application Priority Data

| | | |
|---|---|---|
| Sep. 12, 2003 | (JP) | 2003-321808 |
| Dec. 26, 2003 | (JP) | 2003-434917 |
| Feb. 13, 2004 | (JP) | 2004-037427 |
| Feb. 13, 2004 | (JP) | 2004-037428 |
| Jun. 22, 2004 | (JP) | 2004-184019 |

(51) Int. Cl.
*H05K 9/00* (2006.01)
*H02B 1/44* (2006.01)

(52) U.S. Cl. ..... 174/381; 174/377; 174/384; 174/389; 174/391

(58) Field of Classification Search ..... 174/386, 174/384, 377, 381, 389, 391; 403/23, 430; 361/816, 818
See application file for complete search history.

(56) References Cited

U.S. PATENT DOCUMENTS

| | | | | |
|---|---|---|---|---|
| 3,982,058 | A * | 9/1976 | Hill | 174/2 |
| 4,069,618 | A * | 1/1978 | Geiss | 49/483.1 |
| 4,507,520 | A * | 3/1985 | Lindgren | 174/368 |
| 4,608,453 | A * | 8/1986 | Freeman | 174/363 |
| 4,733,013 | A * | 3/1988 | Hemming | 174/373 |
| 4,740,654 | A * | 4/1988 | Lindgren | 174/371 |
| 4,794,206 | A * | 12/1988 | Weinstein | 174/371 |
| 5,260,128 | A | 11/1993 | Ishii et al. | 428/438 |
| 5,420,550 | A * | 5/1995 | May | 331/143 |
| 5,786,547 | A * | 7/1998 | Zielinski | 174/375 |
| 5,847,316 | A * | 12/1998 | Takada | 174/374 |
| 6,492,587 | B1 * | 12/2002 | Yoshinaga | 174/350 |
| 7,335,838 | B2 * | 2/2008 | Simola | 174/386 |
| 2003/0047338 | A1 * | 3/2003 | Okayama et al. | 174/35 MS |

(Continued)

FOREIGN PATENT DOCUMENTS

| | | |
|---|---|---|
| EP | 0 299 607 | 1/1989 |

(Continued)

*Primary Examiner*—Hung V Ngo
(74) *Attorney, Agent, or Firm*—Kenyon & Kenyon LLP

(57) ABSTRACT

A magnetic shield panel includes a magnetic shield member made of magnetic material; and a metallic plate or a translucent plate member, wherein the magnetic shield member is attached to the metallic plate or the translucent plate member.

20 Claims, 30 Drawing Sheets

U.S. PATENT DOCUMENTS

2005/0233133 A1* 10/2005 Tamai et al. ..... 428/328

FOREIGN PATENT DOCUMENTS

| | | |
|---|---|---|
| JP | 2 178486 | 7/1990 |
| JP | 9 195410 | 7/1997 |
| JP | 9 199884 | 7/1997 |
| JP | 10 046958 | 2/1998 |
| JP | 2002 164686 | 6/2002 |
| TW | 143165 | 10/1990 |
| WO | WO 03/059030 | 7/2003 |

* cited by examiner

MAGNETIC SHIELD PANEL

TECHNICAL FIELD

The present invention relates to a magnetic shield panel used for shielding an influence of magnetism emitted from facilities, in which magnetism is used, to the outside, and also used for shielding an influence of magnetism given to the facilities from the outside.

BACKGROUND ART

On the other hand, the official gazette of Japanese Unexamined Patent Publication No. 2002-164686 discloses an open type magnetic shield method. A magnetic shield room is defined by walls on which a plurality of magnetic shield members, each of which comprises a plurality of strips of magnetic shield material on each other, are arranged perpendicularly along the walls parallel to each other so that the magnetic flux density (the magnetic field intensity) can be attenuated between the opposed faces of the magnetic shield members adjacent to each other.

However, it takes much labor and time to arrange a large number of magnetic shield strip members along the walls in parallel to each other while leaving a gap between them. Further, when an external force is applied to the magnetic shield members, the magnetic shield members are deformed.

DISCLOSURE OF THE INVENTION

The present invention has been accomplished in view of the above points of the prior art. It is an object of the present invention to provide a magnetic shield panel, the magnetic shield members of which can be easily constructed and the shapes of which can be positively maintained. It is another object of the present invention to provide a magnetic shield panel, the visibility through which can be ensured so that a patient can feel easy about being in the magnetic shield room and further a doctor can easily observe a condition of the patient.

The present invention provides a magnetic shield panel characterized in that a magnetic shield member made of magnetic material is attached to a metallic plate.

According to another feature of the present invention, a magnetic shield panel is provided which is characterized in that a magnetic shield member made of magnetic material is attached to a translucent plate member.

Since the magnetic shield panel of the present invention includes a magnetic shield member, the magnetic flux, absorbed by the magnetic shield member, can be diffused through the magnetic shield member. Due to the foregoing, the magnetic shield property can be ensured.

According to the present invention, by forming a panel with a magnetic shield member integrated with a metallic plate or a translucent plate member, the magnetic shield member can be easily applied. Further, by the metallic plate or the translucent plate member, the magnetic shield member can be protected, and a deformation and damage, which are caused when an external force is carelessly given to the magnetic shield member, can be prevented, and the shape of the magnetic shield member can be properly maintained.

Especially when a translucent plate member is used as a face plate, the visibility in a room, in which a magnetic field forming apparatus such as MRI is arranged, can be ensured. Therefore, a patient can feel easy about being in the magnetic shield room and further a doctor can easily observe a condition of the patient.

In this specification, the term "translucent" includes "transparent".

MOST PREFERRED EMBODIMENT

The most preferred embodiment of the present invention will be explained as follows.

Figure 2:
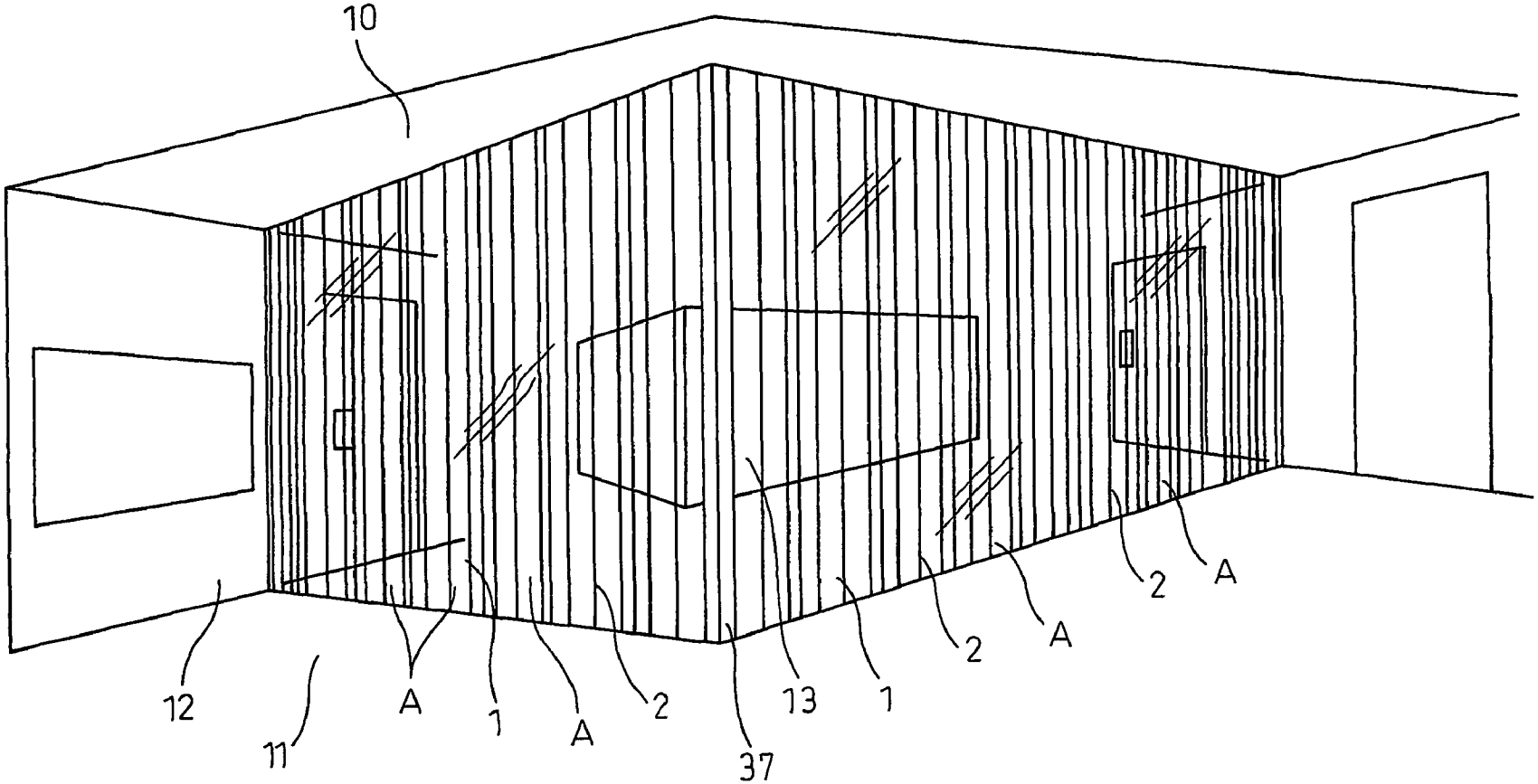
FIG. 2 is a view showing an outline of an example of a magnetic shield room in which the magnetic shield panel shown in FIG. 1 is used.

FIG. 2 is a view showing an example of the magnetic shield room of the present invention.

In this magnetic shield room, two walls 12, which are adjacent to each other, among the ceiling 10, the floor 11 and the four walls, are formed of magnetic shield panels A of the present invention. The magnetic shield panel A is of a vertical type in which magnetic shield members 2 vertically and longitudinary extend. In the present invention, the longitudinal direction of the magnetic shield member 2 may be directed in any direction. However, for example, it is preferable that the longitudinal direction of the magnetic shield member 2 is arranged substantially in parallel to the direction of the magnetic field to be shielded. In the magnetic shield room shown in FIG. 2, since the magnetic field generated from the magnetism generation source 13 such as MRI is formed being directed in the perpendicular direction, the vertical type magnetic shield panel A is used so as to shield this magnetic field. However, the present invention is not limited to the above specific embodiment. In this connection, the ceiling 10, the floor 11 and the other walls 12, which are not composed of the magnetic shield panel A, may be formed of the flat-plate-shaped magnetic shield members, which are put on each other, in the same manner as that of the prior art. It is possible to give the radio wave shielding property to the ceiling 10, the floor 11 and the other walls 12 when metallic sheet such as copper sheet or mesh made of stainless steel is provided on their surfaces.

Figure 1:
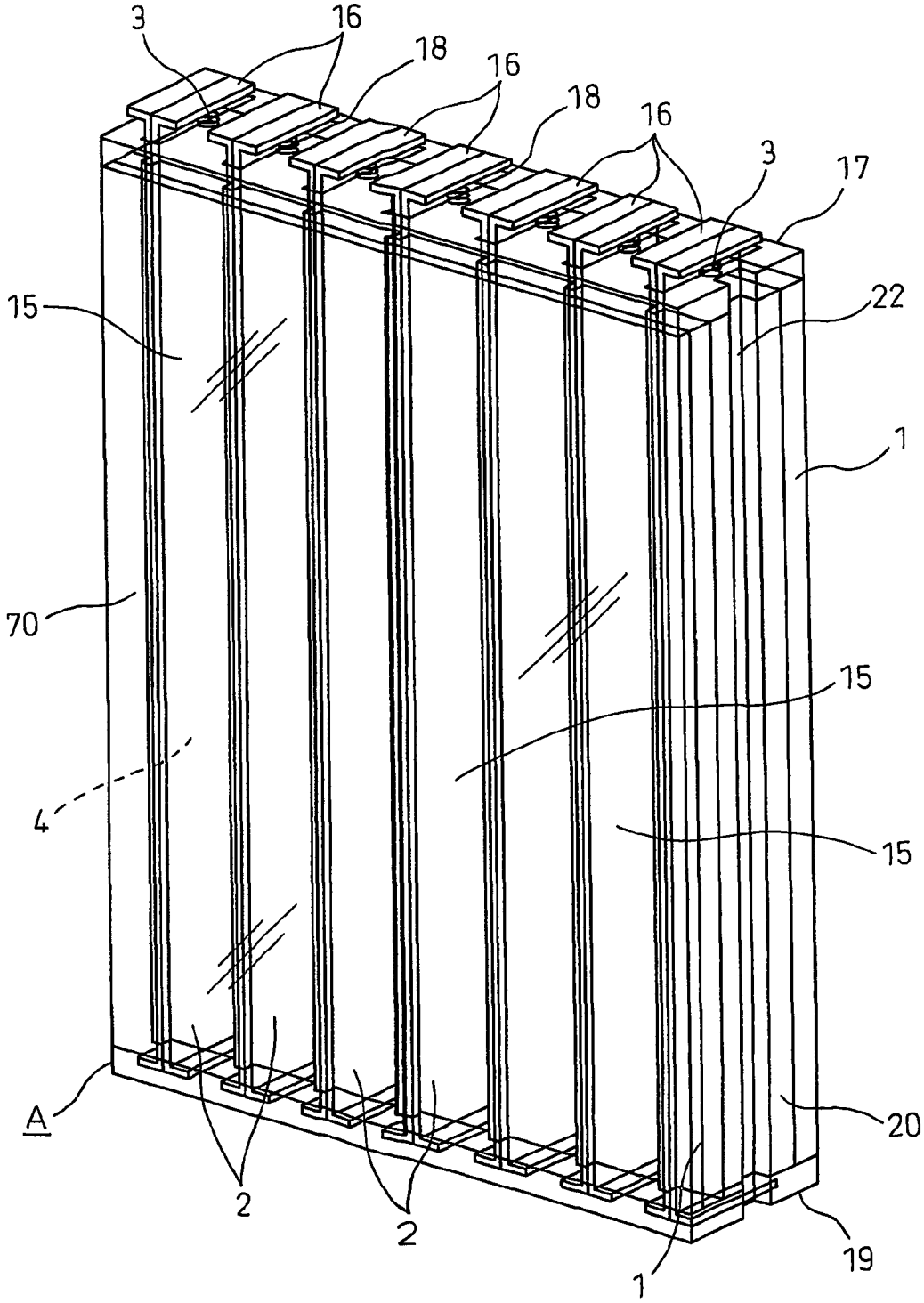
FIG. 1 is a perspective view showing a magnetic shield panel of a preferred embodiment of the present invention.

As shown in FIG. 1, the vertical type magnetic shield panel A of the present embodiment includes: a pair of translucent plate members 1, a magnetic shield member 2, an elastic member 3 and a radio wave shield member 4. Concerning the translucent plate member 1, as long as it is rigid and translucent, any material may be used for the translucent plate member 1. For example, it is possible to use a flat plate made of transparent glass or synthetic resin such as acrylic resin, polycarbonate or vinyl chloride. According to a desired size of the magnetic shield panel A, the size of this plate member 1 may be an appropriate value, for example, the size may be as follows. Length 2384 mm×Width 910 mm×Thickness 8 mm.

Figure 4:
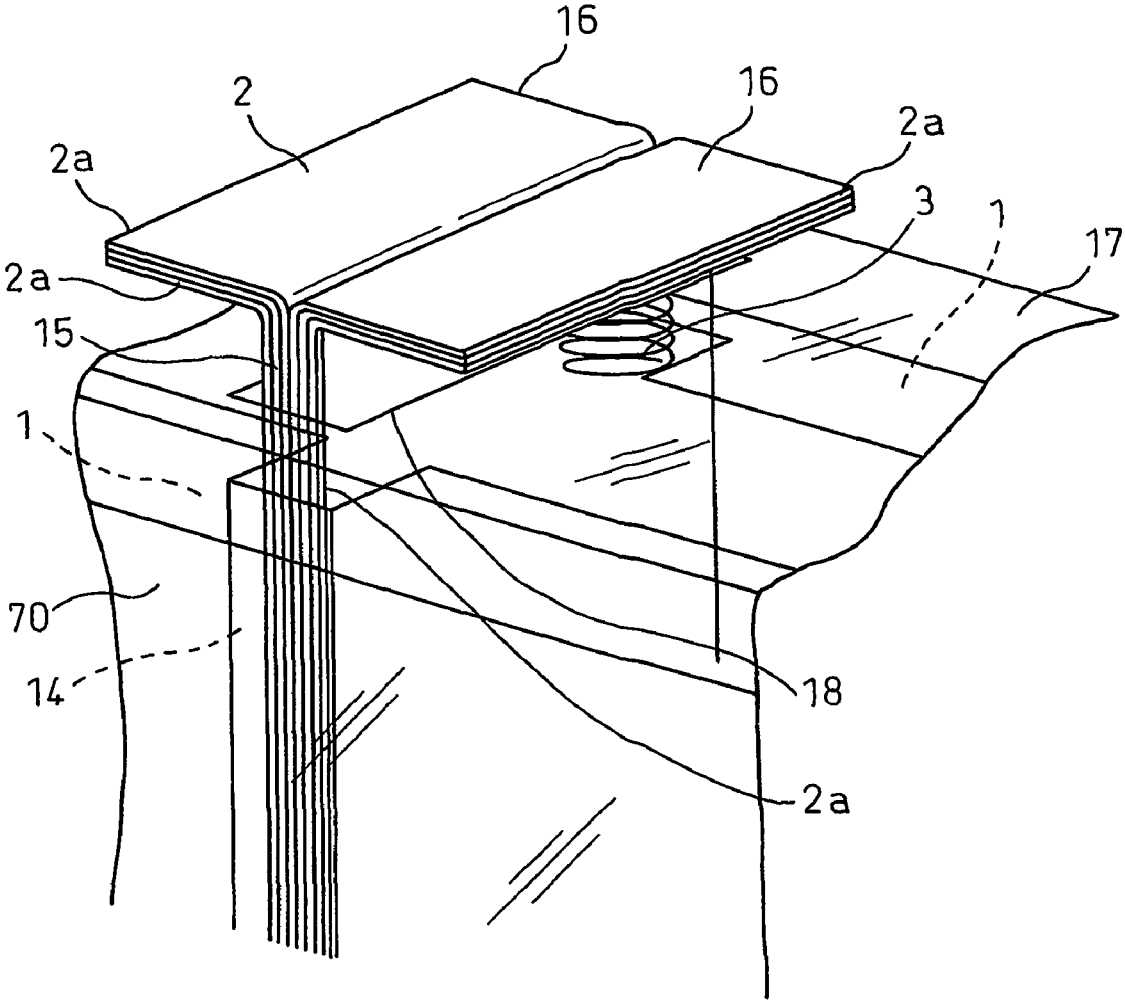
FIG. 4 is a perspective view showing a portion of the magnetic shield panel shown in FIG. 1.

The pair of plate members 1 are arranged in parallel to each other with a gap between them. In one of the pair of plate members 1, on the inner face of the plate member opposing to the other, a plurality of substantially parallel groove portions 14 are formed as shown in FIG. 4. Each groove portion 14 is formed in the vertical direction to extend from the upper end to the lower end of the plate member 1. The groove portions 14 can be formed at substantially regular intervals, however, when necessary, the groove portions 14 are not arranged at regular intervals in some portions. The number of the groove portions 14 corresponds to the number of the magnetic shield member 2. In this connection, as explained below, when the magnetic shield member 2 is arranged between the pair of plate members 1, if it is possible to hold the magnetic shield member 2 by the tension of the elastic member 3 so that the magnetic shield member 2 can not be bent, the groove portion 14 is not necessarily required. However, when consideration is given to the assembling property of assembling the panel, it is preferable to provide the groove 14.

In this connection, in the present invention, it is not necessary that the plate member 1 is completely transparent, that is, the plate member 1 may be a semitransparent material such as figured glass, frosted glass or punching metal. The plate member 1 may have a permiable property. Further, the plate member 1 may be composed in such a manner that one portion is translucent and the other portion is not translucent. For example, the plate member 1 may be composed in such a manner that one of the upper and the lower portion of the plate member 1 is translucent and the other portion is not translucent. In this case, the translucent portion may be composed of a plate member made of transparent glass or synthetic resin such as acrylic resin, and not translucent portion may be composed of a plate member made of plywood or plaster board. According to the present embodiment, a plurality of the above types of plate members 1 can be appropriately combined with each other.

The magnetic shield member 2 used for the present embodiment may be made of magnetic material such as a magnetic steel sheet, Permalloy, amorphous metal or nanocrystal magnetic material ("Finemet (R)" manufactured by Hitachi Kinzoku Co.). As shown in FIG. 3A, the magnetic shield member 2 includes: a rectangular flat plate portion 15 which is long in the perpendicular direction; and engaging portions 16 provided in the upper and the lower end portion of the flat plate portion 15. Therefore, the magnetic shield member 2 is formed into substantially an I-shape when it is viewed from the front. The I-shaped magnetic shield member 2 includes a plurality of sections 2*a* having the engaging portions 16 which are formed when both end portions of a strip member made of magnetic material are bent in the same direction. A plurality of sections 2*a*, in the case of FIG. 3A, three sections 2*a* are put on each other so that a set of sections 2*a* can be composed, and these sets of sections 2*a* are arranged back to back to form an I-shaped magnetic shield member 2. In the embodiment shown in FIG. 3A, the thickness of six sections 2*a* is 0.35 mm. However, the present invention is not limited to the above specific embodiment. The number and the thickness of the sections 2*a* can be appropriately determined.

Figure 3B:
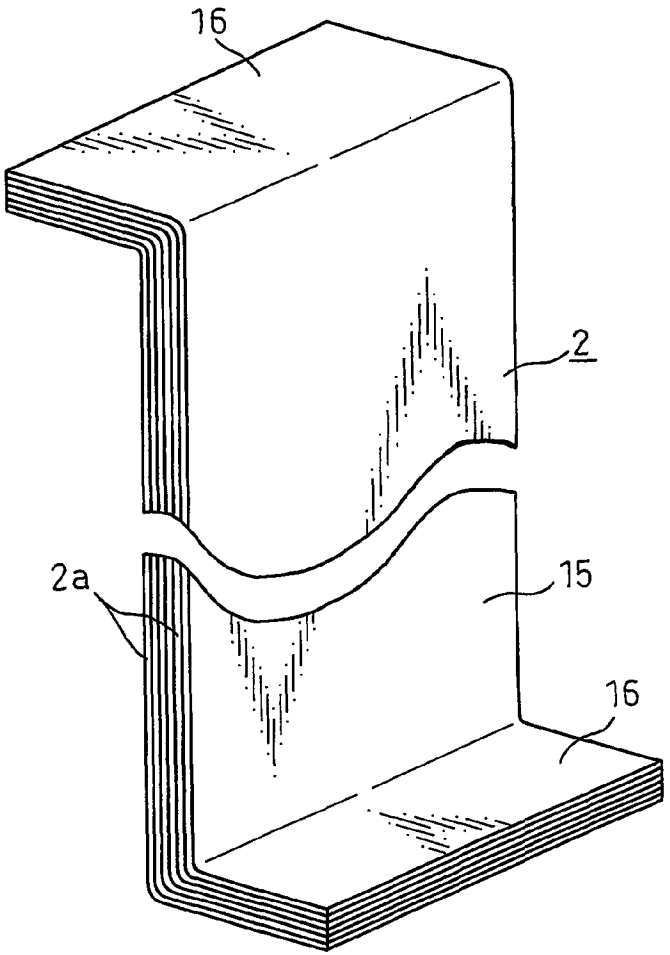
FIG. 3B is a perspective view of a variation of the magnetic shield member.
Figure 3A:
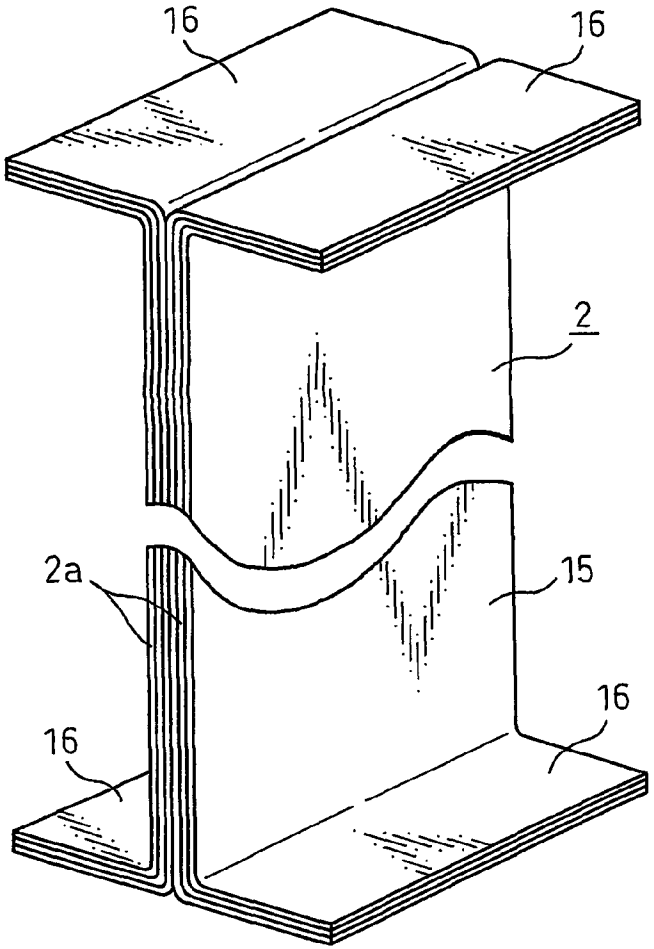
FIG. 3A is a perspective view of a magnetic shield member of the magnetic shield panel shown in FIG. 1.

As shown in FIG. 3B, the magnetic shield member 2 can be composed into substantially a Z-shape when it is viewed from the front. In the case of the I-shaped magnetic shield shown in FIG. 3A, the length of the bent portions of the sections 2*a* to be put on each other must be changed. However, in the case of the Z-shaped magnetic shield shown in FIG. 3B, the sections 2*a* of the same shape can be used. Therefore, the magnetic shield members 2 can be easily manufactured.

Except for the above shape, the cross section of the magnetic shield member 2 may be formed into various shapes such as a cross-shaped section, a Y-shaped section, a circular section, a hollow circular section, a square (rectangular) section, a hollow square (rectangular) section, a star-shaped section, an H-shaped section, an I-shaped section, a T-shaped section, a semicircular section, a triangular section, a vortex-shaped section, a circular section having a multilayer space inside, and a square section having a multilayer space inside. The magnetic shield member 2 can be formed into various shapes such as a simple-rectangular shape, an intermediate portion expanding shape, a rectangular shape having a hole, a needle shape, a triangular shape, a curved rectangular shape, a bent rectangular shape, an angle member shape, a twisted rectangular shape, a spiral shape, a rotary stand shape and a deformed reinforcing bar shape. Corrosion-prevention treatment or coating may be conducted on the magnetic shield member 2. Coating may be carried out by a well known method such as a coating method of dacuronium, organic substance, powder or static electricity.

The radio wave shielding member 4 is made of a metallic mesh (a wire net). Concerning the radio wave shielding member 4, as long as it can shield the radio waves, the frequency of which is 10 kHz to 40 GHZ, any radio wave shielding member may be used, that is, the radio wave shielding member 4 is not particularly limited to the above specific embodiment. For example, it is possible to use a metallic material such as a stainless steel net in which the diameter of the wire is 0.02 to 1.9 mm and the size of the mesh is 1.5 to 635 mesh.

Concerning the elastic member 3, it is possible to use a spring such as a coil spring. However, the elastic member 3 is not limited to a spring, for example, other materials such as rubber may be used.

The magnetic shield panel A of the present embodiment can be composed when one or a plurality of magnetic shield members 2 are attached to the plate member 1. That is, as shown in FIG. 1, the vertical type magnetic shield panel A of the present embodiment can be composed when a plurality of magnetic shield members 2 are interposed between two translucent plate members 1 which are arranged being opposed to each other. The pair of plate members 1 are arranged so that the surfaces, on which the groove portions 14 are formed, can be opposed to each other, and a side edge portion of the flat plate portion 15 of the magnetic shield member 2 is inserted into each groove portion 14. The magnetic shield members 2 are arranged at regular intervals in such a manner flat face portions (faces of the largest area) of the flat plate portions 15 are arranged in parallel to each other while each magnetic shield member 2 is arranged between a pair of plate members. In this case, it is preferable that the magnetic shield panel A of the present embodiment satisfies the following expression (1).

$$(Sm \cdot \mu s)/Sa > 1 \quad (1)$$

where

Sm: area of lateral section of magnetic shield member 2

μs: relative magnetic permeability of magnetic material of magnetic shield member 2

Sa: area of lateral section of space between magnetic shield members 2 adjacent to each other In the same manner as that of the case of the official gazette of Japanese Unexamined Patent Publication No. 2002-164686, the magnetic shield panel A satisfying the expression (1) is capable of attenuating the magnetic flux density at the interval between the opposing magnetic shield members 2 adjacent to each other, and the magnetic shielding effect can be provided.

On the magnetic shield panel A of the present embodiment, the radio wave shield member 4 can be stuck on one face or both faces of a pair of plate members 1. The transparent cover plate 70 can be provided on the surface of this radio wave shield member 4. The cover plate 70 can be formed in the same manner as that of the plate member 1.

The top plate 17 is provided in an upper portion of the magnetic shield panel A of the present embodiment. The top plate 17 is arranged between the upper end portions of the pair of plate members 1 and closes an upper face opening of the space formed between the pair of plate members 1. Except that the size of the top plate 17 is different from the size of the plate member 1, the top plate 17 can be formed in the same manner as that of the plate member 1, however, the top plate 17 is not necessarily transparent. A plurality of through-holes 18, which penetrate the top plate 17 in the thickness direction (the perpendicular direction), are formed on the top plate 17. An upper portion of the flat plate portion 15 of each magnetic shield member 2 is inserted into this through-hole 18. Accordingly, the engaging portion 16 of the upper end of the magnetic shield member 2 is located at a position higher than the top plate 17. As shown in FIG. 4, the elastic member 3 is interposed between the upper face of this top plate 17 and the lower face of the engaging portion 16 on the upper side of the magnetic shield member 2.

The bottom plate 19 is provided in a lower portion of the magnetic shield panel A of the present embodiment. The bottom plate 19 is arranged between the lower end portions of the pair of plate members 1 and closes a lower face opening of the space formed between the pair of plate members 1. Except that the size of the bottom plate 19 is different from the size of the plate member 1, the bottom plate 19 can be formed in the same manner as that of the plate member 1, however, the bottom plate 19 is not necessarily transparent. A plurality of through-holes 18, which penetrate the bottom plate 19 in the thickness direction (the perpendicular direction), are formed on the bottom plate 19. A lower portion of the flat plate portion 15 of each magnetic shield member 2 is inserted into this through-hole 18. Accordingly, the engaging portion 16 of the lower end of the magnetic shield member 2 is located at a position lower than the bottom plate 19. The spacer 23 may be provided being interposed between the lower face of the bottom plate 19 and the upper face of the engaging portion 16 on the lower side of the magnetic shield member 2.

In this embodiment, the magnetic shield member 2 is not fixed to the plate member 1. Therefore, the magnetic shield member 2 can be moved in the perpendicular direction. Accordingly, there is a possibility that an intermediate portion of the magnetic shield member 2 is bent and deformed. However, as described above, the magnetic shield member 2 can be held being stretched in such a manner that the magnetic shield member 2 is pushed being extended in the longitudinal direction by the elastic member 3. Therefore, deterioration of the magnetic shielding property of the magnetic shield panel A can be prevented.

Side plates 20 are provided in both side edge portions of the magnetic shield panel A of the present embodiment. The side plates 20 are arranged between the side edge portions of the pair of plate members 1 so that the side openings of the space formed between the pair of plate members 1 can be closed by the side plates 20. Except that the size and thickness of the side plates 20 are different from the size and thickness of the plate member 1, the side plates 20 can be formed in the same manner as that of the plate member 1, however, the side plates 20 are not necessarily transparent. The engaging protrusion 21 is formed on an outer face of one of the side plates 20, and the engaging recess 22 is formed on an outer face of the other side plate 20.

In this connection, in order to assemble the magnetic shield panel A of the present embodiment, each member can be fixed with the fixture such as screws or bonded with adhesive.

When construction is conducted by arranging a plurality of vertical type magnetic shield panels A in the substantially horizontal direction, the magnetic shield room shown in FIG. 2 can be formed. This magnetic shield room is capable of shielding radio waves by the radio wave shield members 4.

Figure 5B:
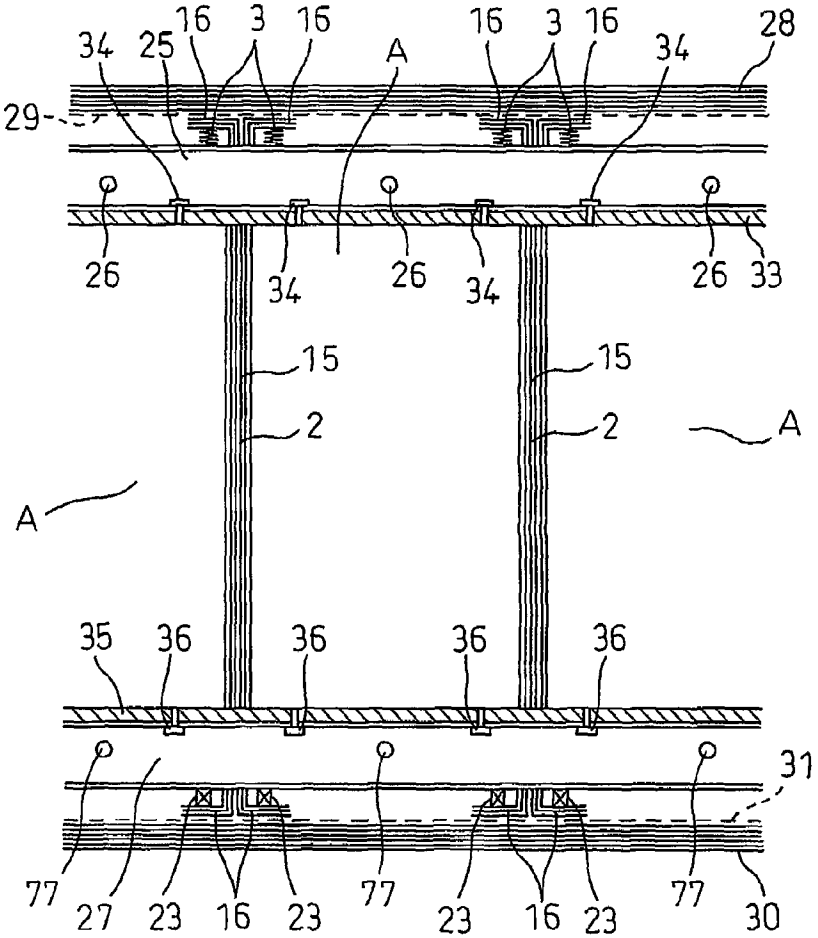
FIG. 5B is a sectional view showing a portion of the magnetic shield room shown in FIG. 2.
Figure 5A:
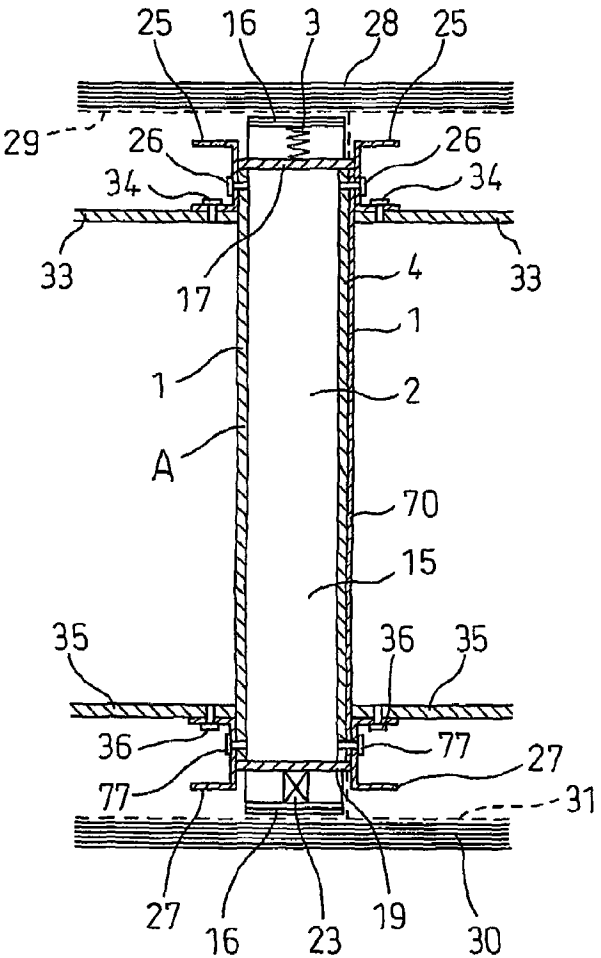
FIG. 5A is a sectional view showing a portion of the magnetic shield room shown in FIG. 2.

As shown in FIGS. 5A, 5B, the magnetic shield panel A of the present embodiment can be fixed to the ceiling structural member 25 of a building, which is composed of a channel steel member, by the fixing fixture 26 such as bolts. At the same time, the magnetic shield panel A of the present embodiment can be fixed to the floor structural member 27 of the building, which is composed of a channel steel member, by the fixing fixture 77 such as bolts. On the reverse side of the ceiling of the magnetic shield room, the ceiling side magnetic shield plate 28, which is made of the same magnetic material as described above, is provided. On the lower face of the ceiling side magnetic shield plate 28, the ceiling side radio wave shield member 29 composed of the same metallic mesh as described above is provided. Under the floor, the under-floor magnetic shield plate 30 made of the same magnetic material as described above is provided. On the upper face of the under-floor magnetic shield plate 30, the floor side radio wave shield member 31 composed of the same mesh as described above is provided.

The magnetic shield panel A of the present embodiment is attached to the floor, ceiling and wall so that a gap formed between the magnetic shield member 2 and the under-floor magnetic shield plate 30 and a gap formed between the magnetic shield member 2 and the ceiling side magnetic shield plate 28 can be not more than 2 mm, preferably not more than 0.5 mm. In the present embodiment, the magnetic shield member 2 is formed into a substantial I-shape or Z-shape. Therefore, the upper end face and lower end face of the magnetic shield member 2 can be made to be planes which are substantially parallel to the surfaces of the ceiling side magnetic shield plate 28 and the under-floor magnetic shield plate 30. Therefore, the ceiling side magnetic shield plate 28 and the under-floor magnetic shield plate 30 can be excellently joined to the engaging portion 16. Therefore, the magnetically shielding performance can be positively ensured. In this connection, the top plate 33 is fixed to a lower face of the ceiling structural member 25 by the fixing fixture such as bolts, and the floor plate 35 is fixed to an upper face of the floor structural member 27 by the fixing fixture 36 such as bolts.

Figure 6A:
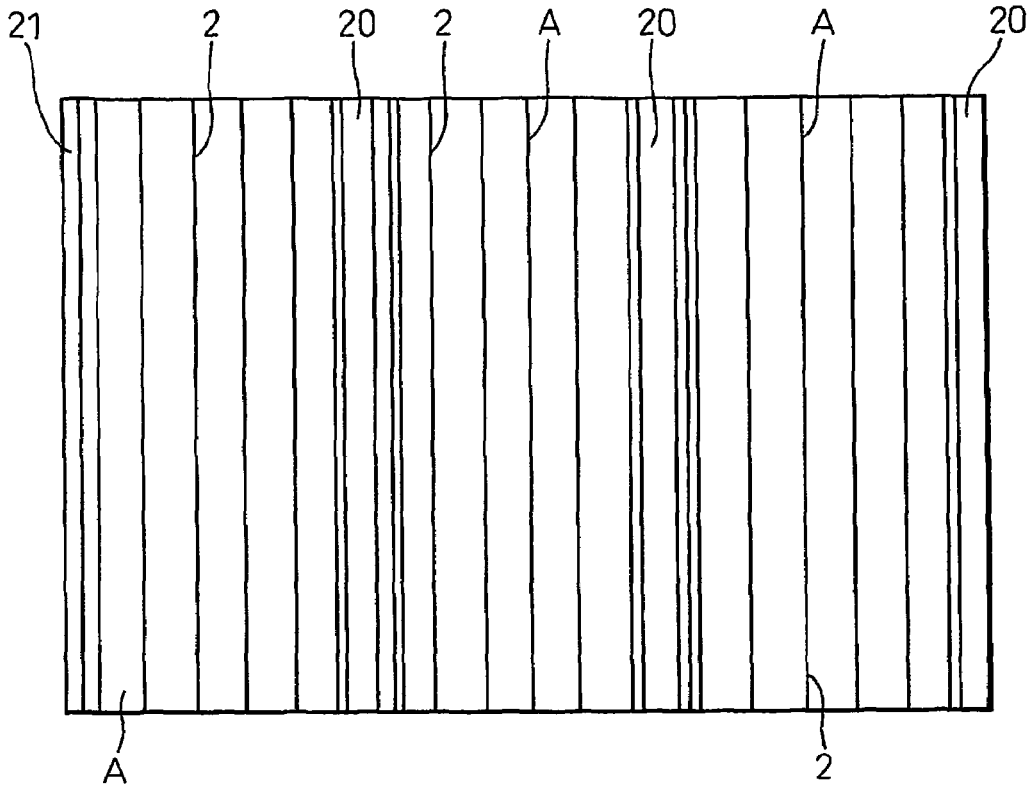
FIG. 6A is a front view briefly showing a plurality of magnetic shield panels connected to each other.
Figure 6B:
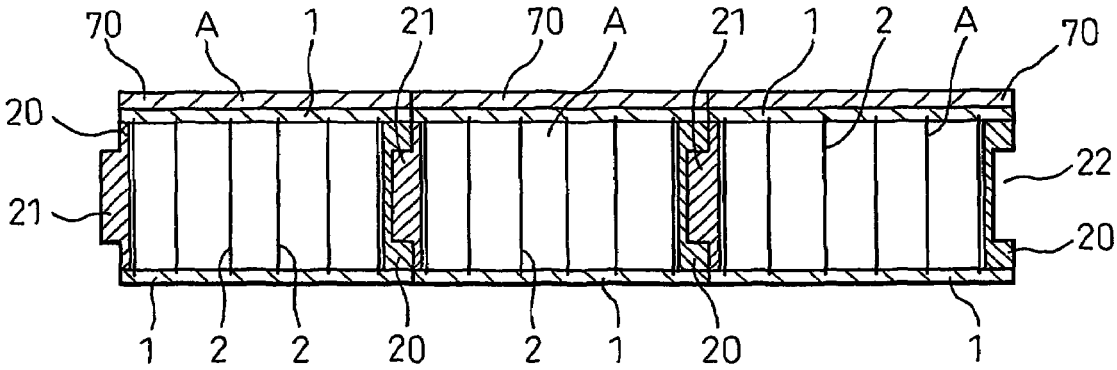
FIG. 6B is a sectional view showing a plurality of magnetic shield panels connected to each other.
Figure 7:
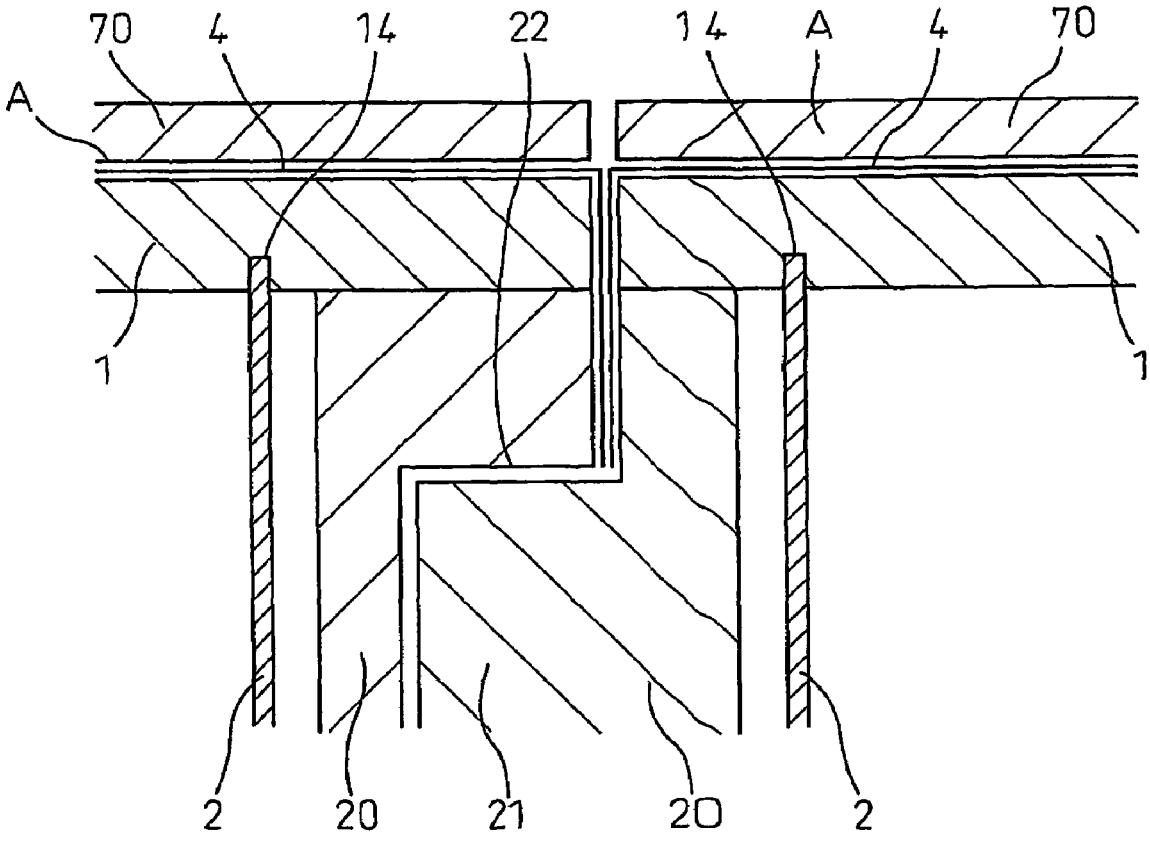
FIG. 7 is a sectional view showing a portion of two magnetic shield panels connected to each other.

As shown in FIGS. 6A, 6B, the magnetic shield panels A, which are adjacent to each other in the horizontal direction (the lateral direction), are connected to each other by the engagement of the engaging protrusion 21 with the engaging recess 22. At this time, as shown in FIG. 7, side edge portions of the radio wave shield members 4, which are guided out from the side edge portions of the magnetic shield panels A, are pinched between the side plates 20 of the magnetic shield panels A which are adjacent to each other. Accordingly, the radio wave shield members 4 of the magnetic shield panels A, which are adjacent to each other, are connected to each other.

Figure 8:
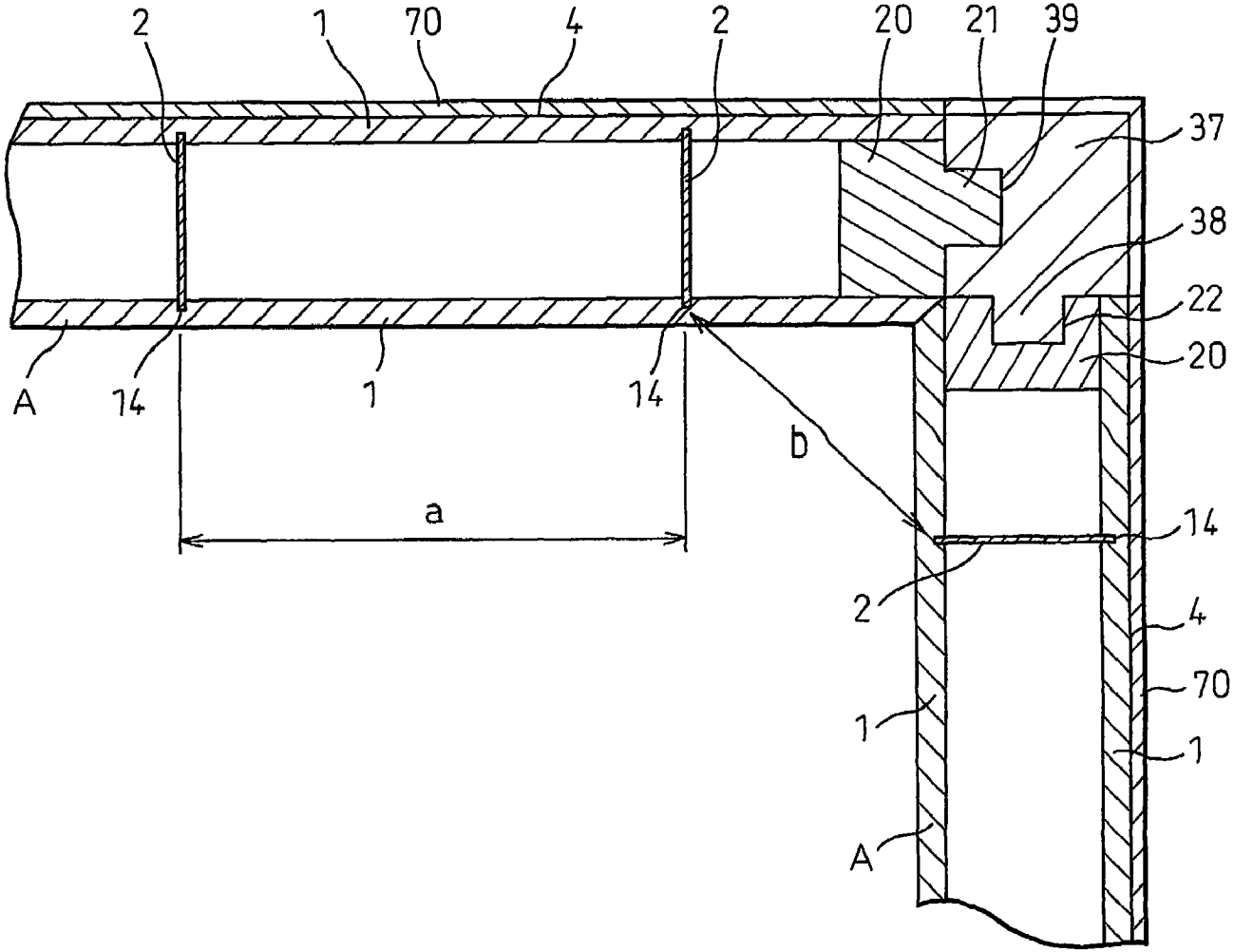
FIG. 8 is a partial sectional view showing a corner portion formed by two magnetic shield panels connected to each other at a right angle.

As shown in FIG. 8, at the corner portion of the magnetic shield room, two magnetic shield panels A, which are directed at a right angle, are connected to each other via the pillar member 37. In this case, the engaging protrusion 38 is formed on one side of the pillar member 37. This engaging protrusion 38 is engaged with the engaging recess 22 of the magnetic shield panel A. On the other side of the pillar member 37, the engaging recess 39 is formed. This engaging recess 39 is engaged with the engaging protrusion 21 of the magnetic shield panel A. Concerning the magnetic shield panels A connected to each other via the pillar member 37, the radio wave shield members 4 are connected to each other by a portion of the pillar member 37.

On the two magnetic shield panels A which are adjacent and connected to each other via the pillar member 37, it is preferable that the distance "b" between the magnetic shield members 2, which are located at the closest positions to the pillar member 37, is smaller than the interval "a" of the magnetic shield members 2 arranged between the plate members 1 of one magnetic shield panel A. Due to the foregoing, deterioration of the magnetic shielding property of the magnetic shield member can be prevented.

Figure 9A:
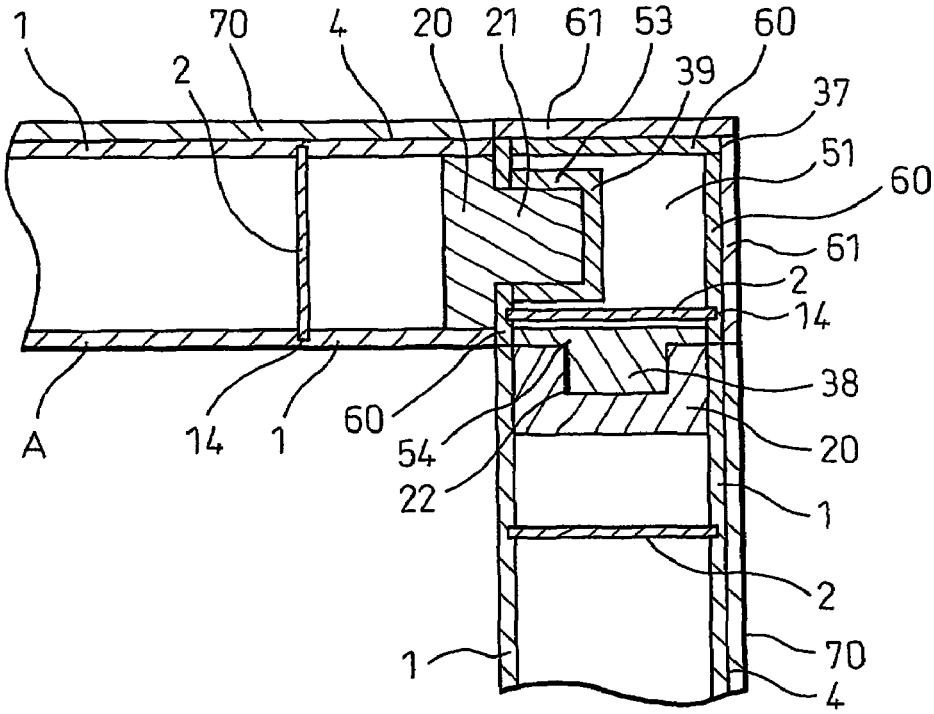
FIG. 9A is a partial sectional view showing a corner portion formed by two magnetic shield panels connected to each other at a right angle of another embodiment.

As shown in FIGS. 9A. 9B, it is possible to use a pillar member 37 into which the magnetic shield member 2 is incorporated. This pillar member 37 is formed to be hollow, and the magnetic shield member 2 is accommodated in the accommodating space 51 formed inside the pillar member 37. This pillar member 37 is formed into the same shape as that of the solid pillar member shown in FIG. 8. This hollow pillar member 37 can be composed when a plurality of pillar plate members 60, the recess member 53, the cross section of which is a substantial C-shape, and the protrusion member 54, the cross section of which is a substantial protrusion, are combined with each other. In this case, the recess member 53 can be made to be the engaging recess portion 39, and the protrusion member 54 can be made to be the engaging protrusion 38. The pillar member 60, the recess member 53 and the protrusion member 54 can be made of the same transparent or opaque material as that of the plate member 1. Two outer faces (the faces on the opposite side to the engaging recess portion 39 and the engaging protrusion 38) of the pillar member 37 are provided with the pillar cover plate 61 which is formed in the same manner as that of the above cover plate 70.

Figure 9B:
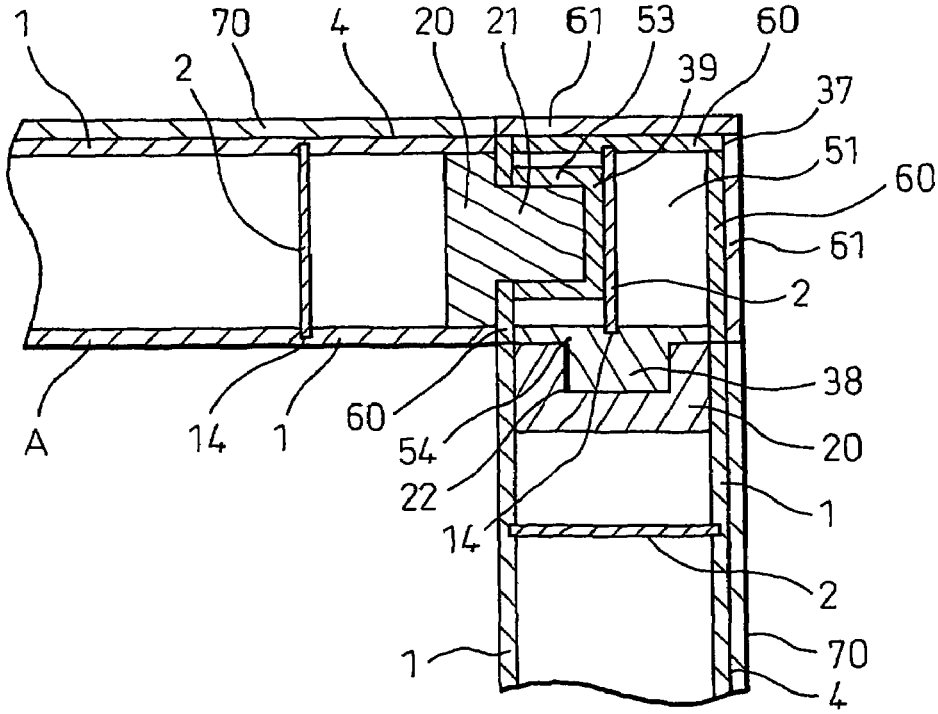
FIG. 9B is a partial sectional view showing a corner portion formed by two magnetic shield panels connected to each other at a right angle of still another embodiment.

The magnetic shield member 2 is accommodated in the accommodating space 51 all over the length of the accommodating space 51 in the perpendicular direction. In this case, as shown in FIG. 9A, the magnetic shield member 2 can be arranged along the inner face of the protrusion member 54. Alternatively, as shown in FIG. 9B, the magnetic shield member 2 can be arranged along the inner face of the recess member 53. In the examples shown in FIGS. 9A, 9B, the magnetic shield members 2 are arranged, meeting at a right angle with each other in the plan view. However, in any case, an arrangement is made so that the flat portion 15 of one magnetic shield member 2 of the two magnetic shield panels A connected to the pillar member 37 can be opposed to the flat plate portion 15 of the magnetic shield member 2 in the pillar member 37. An end portion of the magnetic shield member 2 is inserted into the groove portions 14 provided on the inner face of the pillar plate member 60 and the inner face of the protrusion member 54. When the magnetic shield member 2 is provided in the pillar member 37 as described above, it is possible to prevent the magnetic shield performance from being deteriorated by the pillar portion 37.

Concerning the magnetic shield room, a portion or all of at least one face of the ceiling face 10, the floor face 11 and the wall face 12 can be composed of the above magnetic shield panel A. In this case, the circumstances outside the room can be seen from the inside of the room through the magnetic shield panel A. Further, the circumstances inside the room can be seen from the outside of the room through the magnetic shield panel A. Therefore, the magnetic shield room can be preferably used for MRI apparatus room in a hospital.

Figure 10:
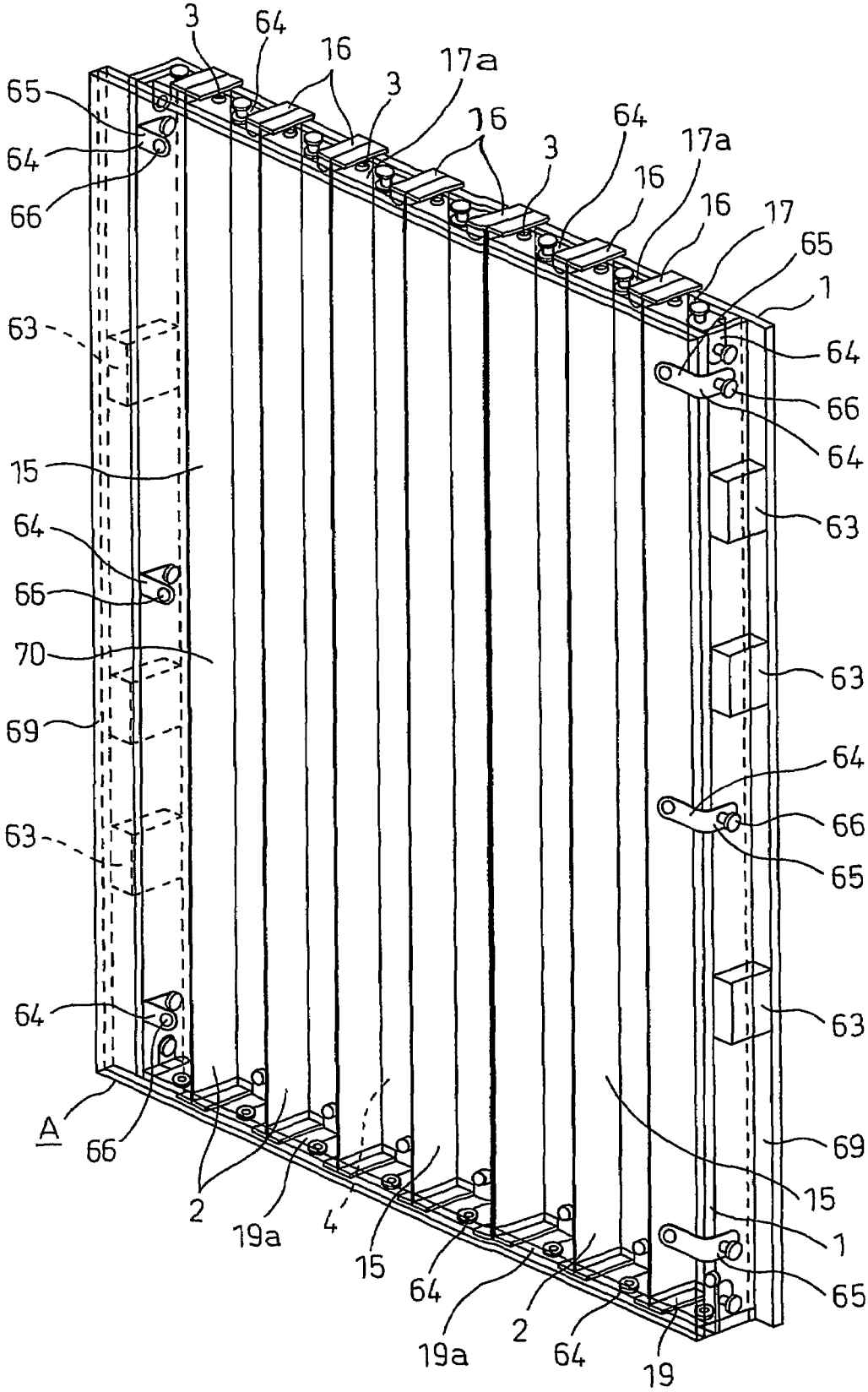
FIG. 10 is a perspective view showing a magnetic shield panel of another embodiment of the present invention.

FIGS. 10 and 11 are views showing another embodiment of the magnetic shield panel A. On this magnetic shield panel A, the plate member 1, the cover plate 70, the top plate 17, the floor plate 19 and the side plate 20 are composed of a transparent glass plate. As described before, the plate member 1 can be formed into a predetermined size. In this structure, two pieces of the plate members 1 are used as one set. However, the plate members 1 does not have a constitution corresponding to the groove portion 14 described before, that is, the inner face (the opposing face) of the plate member 1 is a flat face. The magnetic shield member 2, the elastic member 3 and the radio wave shield member 4 can be formed in the same manner as that of the embodiment described before.

The top plate 17 is composed of a plurality of top plate members 17*a*. When the top plate members 17*a* are arranged at predetermined intervals, the top plate members 17*a* are arranged between the upper end portions of a pair of plate members 1 so that an upper face opening of the space formed between the pair of plate members 1 can be closed. A gap formed between the top plate members 17*a* adjacent to each other is formed as a through-hole 18 provided on the top plate 17.

The floor plate 19 is composed of a plurality of floor plate members 19*a*. When the floor plate members 19*a* are arranged at predetermined intervals 19*b*, the floor plate members 19*a* are provided between the lower end portions of a pair of plate members 1 so that a lower face opening of the space formed between the pair of plate members 1 can be closed. An interval between the bottom plate members 19*a*, which are adjacent to each other, is formed as a through-hole 18 provided on the bottom plate 19. Further, on the side plate 20, the engaging protrusion 21 and the engaging recess portion 22 are not formed, that is, the side plate 20 is formed into a flat plate shape, and a plurality of gap members 63 are provided on an outer face of the side plate 20.

Figure 11A:
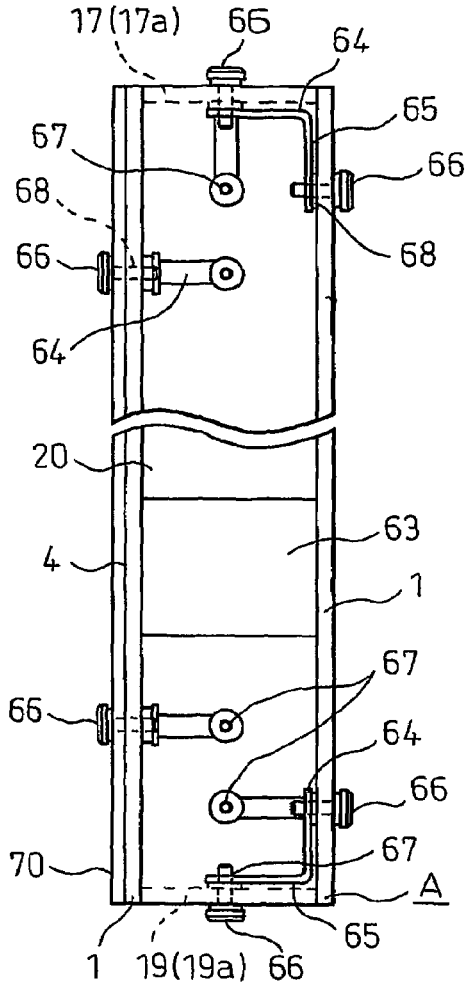
FIG. 11A is a partial side view showing a magnetic shield panel shown in FIG. 10.
Figure 11B:
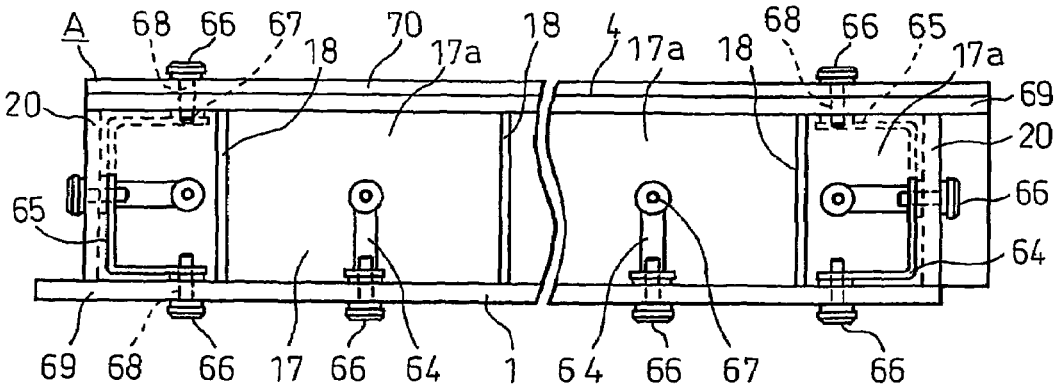
FIG. 11B is a partial plan view showing the magnetic shield panel shown in FIG. 10.

When the plate member 1, the cover plate 70, the ceiling member 17*a*, the bottom member 19*a*, the side plate 20, the magnetic shield member 2, the elastic member 3 and the radio wave shield member 4 are assembled in the same manner as described before, the magnetic shield panel A can be formed. As shown in FIGS. 11A, 11B, when the plate member 1, the cover plate 70, the ceiling member 17*a*, the bottom plate member 19*a* and the side plate 20 are assembled, the connecting fixtures 64 are used. Each connecting fixture 64 is comprised of an L-shaped angle steel member 65 and a plurality of connection screws 66. In both end portions of the angle steel member 65, the screw holes 67 capable of being screwed to the connection screws are provided. On the plate member 1, the cover plate 70, the ceiling member 17*a*, the floor plate member 19*a* and the side plate 20, the through-hole 68 penetrating in the thickness direction is provided.

Figure 12A:
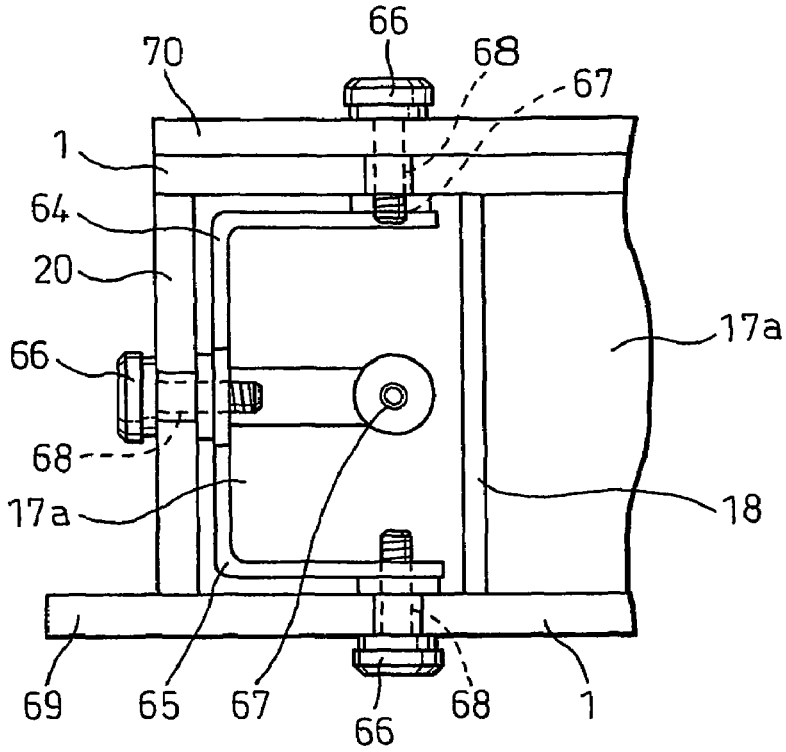
FIG. 12A is a plan view showing a portion of a magnetic shield panel of another embodiment.
Figure 12B:
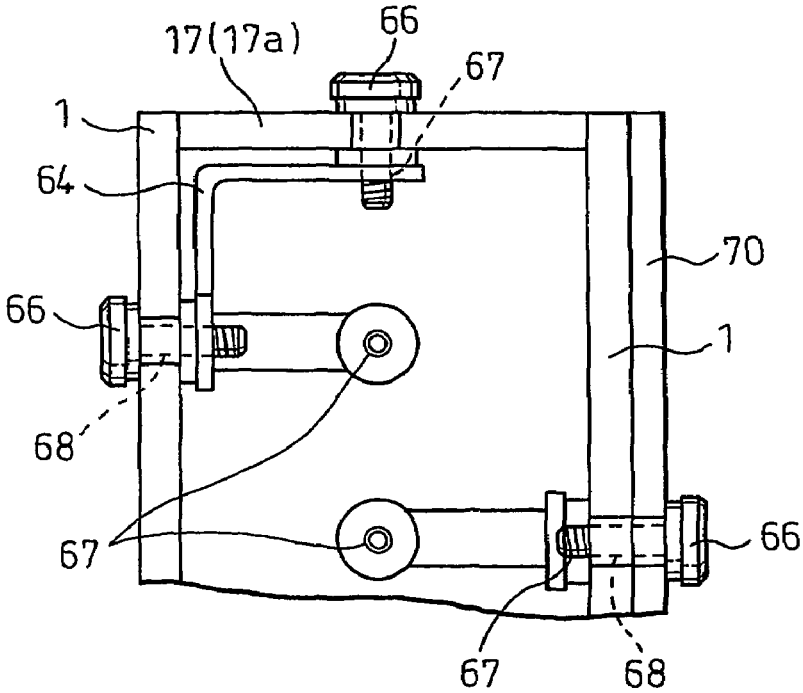
FIG. 12B is a partial side view showing a magnetic shield panel shown in FIG. 12A.

A method of connecting the above members of the plate member 1 and others by using the connecting fixture 64 will be explained as follows. First, the angle steel member 65 is arranged between the members to be connected by the connecting fixture 64. That is, as shown in FIGS. 12A and 12B, the angle steel member 65 is arranged between the plate member 1 and the top plate member 17*a*, between the plate member 1 and the bottom plate member 19*a*, between the plate member 1 and the side plate 20, between the side plate 20 and the top plate 17*a* and between the side plate 20 and the bottom plate member 19*a*. At this time, the angle steel member 65 is arranged on the inner face side of the cover plate 70, the ceiling member 17*a*, the bottom plate member 19*a* and the side plate 20. The through-holes 68 provided on the cover plate 70, the ceiling member 17*a*, the bottom plate member 19*a* and the side plate 20 are positioned to the screw hole 67.

Next, the connecting screw 66 is inserted into the through-hole 68 from the outer face side of the cover plate 70, the top plate member 17*a*, the bottom plate member 19*a* and the side plate 20, and a forward end portion of the connection screw 66 is screwed into the screw hole 67 of the angle steel member 65. At this time, in the case where the cover member 70 is provided on an outer face of the plate member 1, the connection screw 66 is inserted from an outer face of the cover member 70 via the through-holes 68 of the cover member 70 and the plate member 1. In this way, the cover plate 70, the top plate member 17*a*, the bottom plate member 19*a* and the side plate 20 are connected to each other. In this connection, the pair of plate members 1 are not just rightly opposed to each other but they are opposed to each other being somewhat displaced from each other. Due to the above structure, the protruding piece 69 is formed out of the side edge portion protruding outside from the side plate 20 of the plate member 1.

The magnetic shield panel A illustrated in FIG. 10 can be fixed to the ceiling structural member 25 and the floor structural member 27 by the same method as that described before. However, the magnetic shield panels A, which are adjacent to each other in the horizontal direction (the lateral direction), are not connected by means of engagement but they are fixed to each other when the side plates 20 are butted to each other. When the magnetic shield panels A, which are adjacent to each other in the horizontal direction (the lateral direction), are butted and fixed to each other, the magnetic shield panels A can be positioned in the perpendicular direction by the gap members 63. In this connection, the thickness of the gap member 63 is substantially the same as the protruding length of the protruding piece 69 from the side plate 20. The thickness of the head portion of the connecting screw 66 is smaller than the thickness of the gap member 63.

Figure 13:
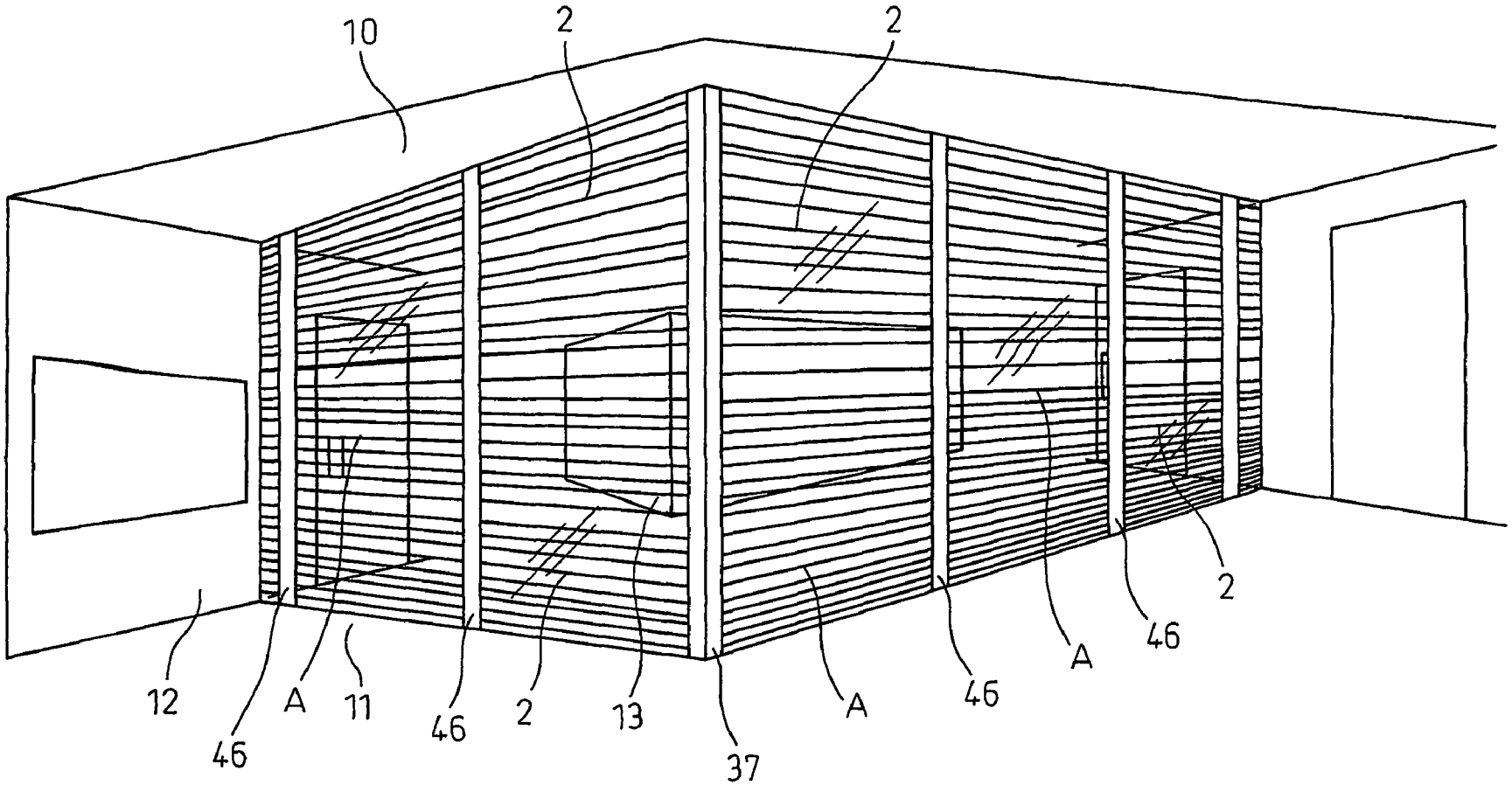
FIG. 13 is a schematic illustration showing an embodiment of a magnetic shield room in which a horizontal type shield panel is used.

FIG. 13 is a view showing a magnetic shield room of another embodiment of the present invention.

In this magnetic shield room, two wall faces among the ceiling face 10, the floor face 11 and the four wall faces 12 are formed out of the magnetic shield panels A of the present embodiment. In the present embodiment, the magnetic shield panel A is a horizontal type magnetic shield panel A on which the magnetic shield member 2 is horizontally formed, that is, the magnetic shield member 2 is formed in the lateral direction. In the magnetic shield room shown in FIG. 13, a direction of the magnetic field generated from the magnetism generator 13 is lateral (substantially horizontal). In order to shield this magnetic field, the lateral type magnetic shield panel A is used in the present embodiment. However, the present invention is not limited to the above specific embodiment. In this connection, the following constitution may be adopted. For the ceiling face 10, the floor face 11 and other wall faces 12, which are not composed of the magnetic shield panel A, the conventional tightly closed type magnetic shield panel is used, and their surfaces are covered with metallic foil such as copper foil or mesh made of stainless steel so as to give the radio wave shielding property to the magnetic shield panel.

The horizontal type magnetic shield panel A includes a pair of translucent plate member 1, a magnetic shield member 2 and a radio wave shield member 4. Longitudinal directions of the plate member 1 and the groove portion 14 are substantially horizontal. Except for that, the horizontal type magnetic shield panel is composed in the same manner as that of the vertical type magnetic shield panel described before. That is, the groove portion 14 is formed all over the length of the plate member 1 in the horizontal direction so that the groove portion 14 can be provided from one end of the plate member 1 to the other end. The magnetic shield member 2 used for the horizontal type magnetic shield panel A is formed into a rectangular plate shape which is long in the horizontal direction. Except for that, the magnetic shield member 2 used for the horizontal type magnetic shield panel A is formed in the same manner as that of the vertical type magnetic shield panel described before. That is, the magnetic shield member 2 includes: a rectangular-plate-shaped flat plate portion 15 which is long in the horizontal direction; and a forward end portion 40 adjoining both end portions of the flat plate portion 15 in the longitudinal direction. In the magnetic shield member 2, the engaging portion 16, which is provided in the embodiment described before, is not formed. The radio wave shield member 4 used for the horizontal type magnetic shield panel A is the same as that of the vertical type magnetic shield panel described before. In this connection, the horizontal type magnetic shield panel A is not provided with the elastic member 3 and the side plate 20.

On the horizontal type magnetic shield panel A, the magnetic shield member 2 is extended long in the horizontal direction. Except for that, the horizontal type magnetic shield panel A can be formed in the same manner as that of the vertical type magnetic shield panel A. That is, a plurality of magnetic shield members 2 are arranged between a pair of plate members 1 which are arranged being opposed to each other. The pair of plate members 1 are arranged in such a manner that one side of one plate member 1, on which the groove portion 14 is formed, is opposed to one side of the other plate member 1 on which the groove portion 14 is formed, and a side edge portion of the flat plate portion 15 of the magnetic shield member 2 is inserted into the groove portion 14. The magnetic shield members 2 are arranged, being separate from each other, at predetermined intervals between the pair of plate members 1 so that the plane portions (the faces of the largest area) of the flat plate portions 15 can be opposed to each other. Even in the case of the horizontal type magnetic shield panel A, it is preferable that the expression (1) is satisfied. When this condition is satisfied, the magnetic shield property can be provided.

The horizontal type magnetic shield panel A includes the same radio wave shield member 4 as that of the vertical type magnetic shield panel. On the surface, the transparent cover plate 70 is provided on its surface. On the horizontal type magnetic shield panel A, in the same manner as that of the embodiment described before, the top plate 17 and the bottom plate 19 are provided, however, the aforementioned through-hole 18 is not formed on the top plate 17 and the bottom plate 19.

Further, the horizontal type magnetic shield panel A does not include the side plate 20 which is provided in the vertical type magnetic shield panel. A space formed between the pair of plate members 1 is open to the side of the magnetic shield panel A. The forward end portion 40 of the magnetic shield member 2 arranged between the pair of plate members 1 is protruded from there. On the horizontal magnetic shield panel A, the magnetic shield member 2 is not fixed to the plate member 1 but can be moved in the horizontal direction. When the magnetic shield member 2 is inserted into the groove portion 14, the magnetic shield member 2 can be held between the pair of plate members 1 without being bent in the central portion. Therefore, deterioration of the magnetic shield property of the horizontal magnetic shield panel A can be prevented.

Figure 14A:
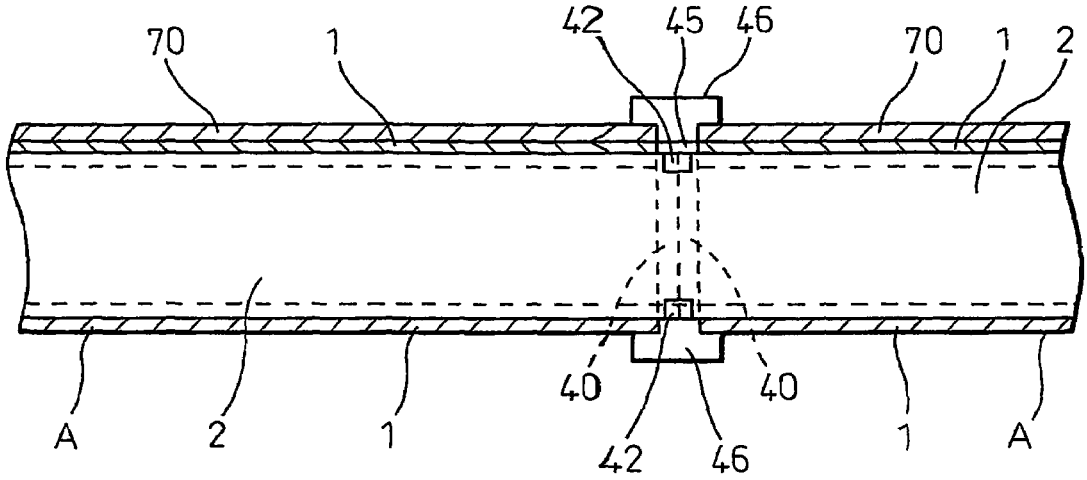
FIG. 14A is a sectional view briefly showing a portion of the magnetic shield room shown in FIG. 13.
Figure 14B:
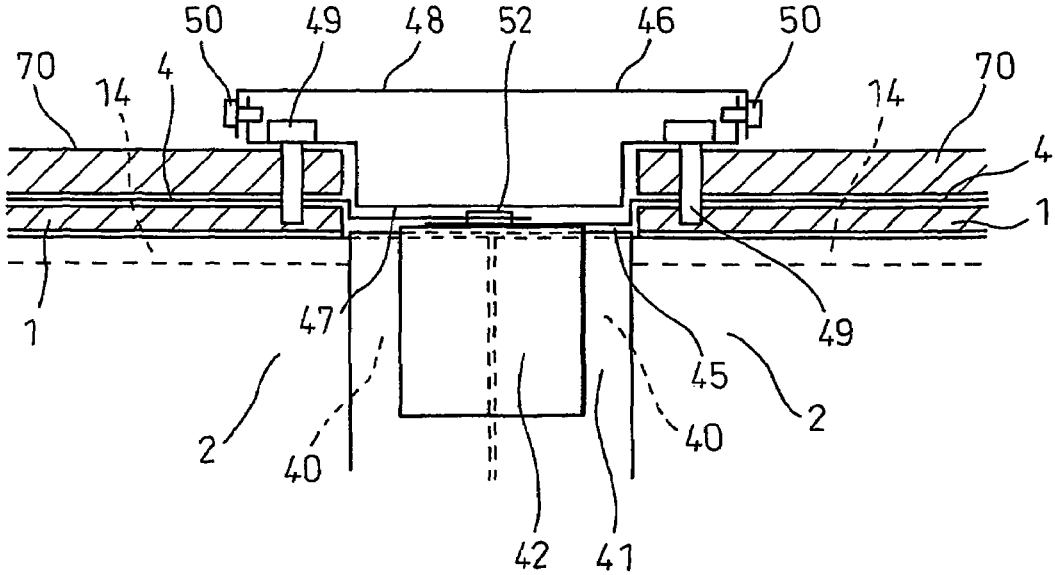
FIG. 14B is a partially enlarged sectional view of FIG. 14A.

When a plurality of horizontal type magnetic shield panels A are arranged in the perpendicular and the horizontal direction, the magnetic shield room shown in FIG. 13 can be formed. In the same manner as described above, this magnetic shield room can also shield radio waves by the radio wave shield member 4. The horizontal type magnetic shield panels A can be subjected to construction in the same manner as that of the vertical type magnetic shield panels. The horizontal type magnetic shield panels A, which are located at the uppermost and the lowermost position, are respectively fixed to the ceiling structural member 25 and the floor structural member 27, and the magnetic shield panels A adjacent to each other in the horizontal direction are connected with each other by the accessory 46. That is, as shown in FIGS. 14A and 14B, on the front and the reverse face of the horizontal type magnetic shield panels A, the joint (the gap) 45 is formed between the side edge portions of a pair of plate members 1. The accessory 46, the cross section of which is a substantially T-shape, is arranged in this joint 45. The magnetic shield panels A can be fixed by this accessory 46. The accessory 46 can be a molding made of metal such as aluminum, however, other metals can be used for molding the accessory 46. The accessory 46 is provided with a base member 47 and a cover member 48. The base member 47 is attached to the plate member 1 and the cover plate 70 by the fixing fixture 49 such as a screw. The cover member 48 is attached to the base member 47 by the fixing fixture 50 such as a screw.

Figure 15A:
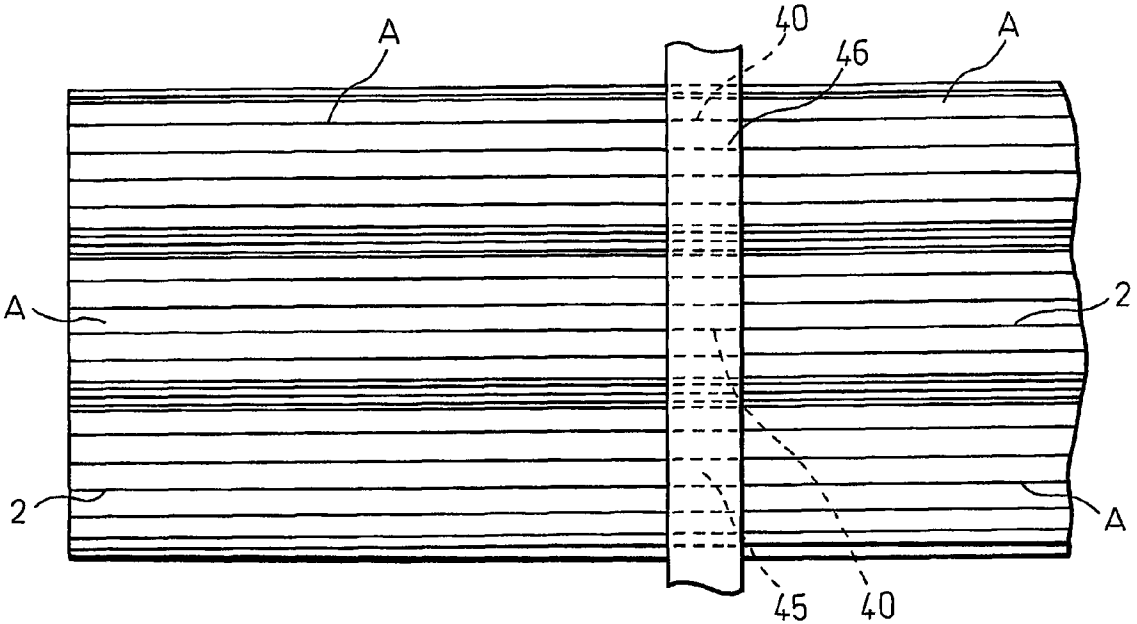
FIG. 15A is a schematic illustration showing a portion of the magnetic shield room shown in FIG. 13.
Figure 15C:
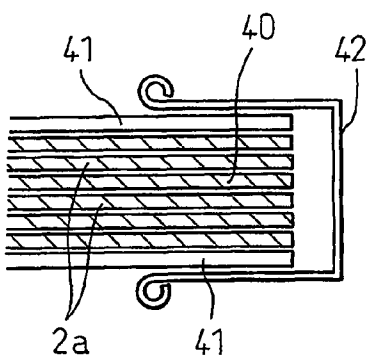
FIG. 15C is a sectional view showing a portion of the magnetic shield room shown in FIG. 13.
Figure 15B:
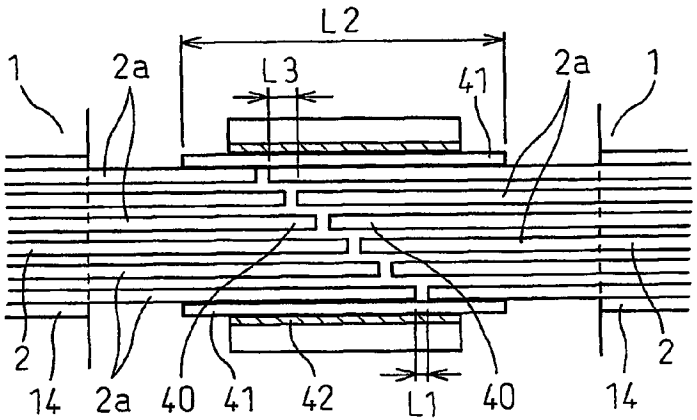
FIG. 15B is a sectional view showing a portion of the magnetic shield room shown in FIG. 13.

The forward end portion 40 of the magnetic shield member 2 protruding outside (on the side) of the side edge portion of a pair of plate members 1 is adjacent to the horizontal type magnetic shield panels A adjoining in the horizontal direction. As explained below, the forward end portions 40 are connected to each other. Referring to FIGS. 15A and 15B, the forward end portion 40 of the section 2*a* protruding from one of the magnetic shield panel A which are adjacent to each other and the forward end portion 40 of the section 2*a* protruding from the other magnetic shield panel A are arranged being opposed to each other while leaving a predetermined interval L1 (not more than 2 mm, preferably not more than 0.5 mm). Next, the forward end portions 40, which are opposed to each other, are interposed between a pair of patches 41. Therefore, the forward end portions 40 are clamped in the perpendicular direction by the clamping fixture 42 such as a clip together with the patches 41 as shown in FIG. 15C. In this case, the patches 41 are made of the same material as that of the section 2*a* , and the length is preferably not less than 50 mm. In this case, the length is the size in the same direction as the longitudinal direction of the section 2*a*.

It is preferable that a plurality of shield members 2*a* composing the magnetic shield member 2 has a predetermined length L3, preferably a predetermined length L3 which is not less than 10 mm, and the plurality of shield members 2*a* are arranged being offset in the longitudinal direction. Due to the foregoing, end portions of the sections 2*a* of the magnetic shield member 2 are not arranged on the perpendicular straight line but arranged on an oblique line. Further, side edge portions of the radio wave shield members 4 protruding from the side edge portions of the horizontal type magnetic shield panels A, which are adjacent to each other in the horizontal direction, are connected with each other by the connecting member 52. The side edge portions of the electric shield member 4 are connected to each other by the joint 45 on the reverse side of the accessory 46.

In this connection, it is possible to form a magnetic shield room when both the vertical and the horizontal type magnetic shield panel A are used. In this case, the vertical and the horizontal type magnetic shield panel A are arranged before and behind so that the plate member 1 of the vertical type magnetic shield panel A and the plate member 1 of the horizontal type magnetic shield panel A can be opposed to each other. Due to the foregoing, not only the magnetic fields in the perpendicular and the horizontal direction but also the magnetic fields in all directions can be shielded.

Figure 16B:
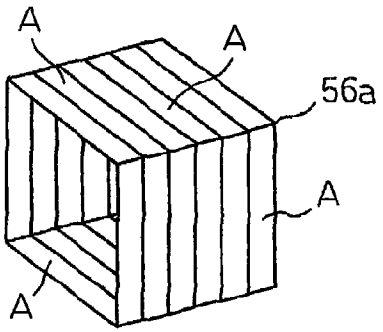
FIG. 16B is a schematic illustration showing an example of a square cylindrical body of a magnetic shield unit of another embodiment of the present invention.
Figure 16C:
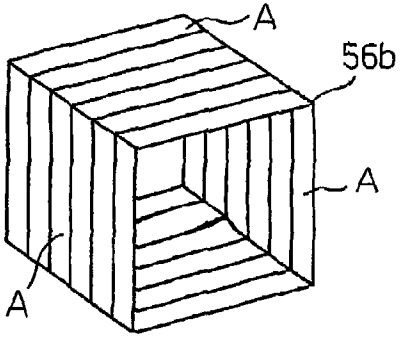
FIG. 16C is a schematic illustration showing an example of a square cylindrical body of a magnetic shield unit of another embodiment of the present invention.
Figure 16D:
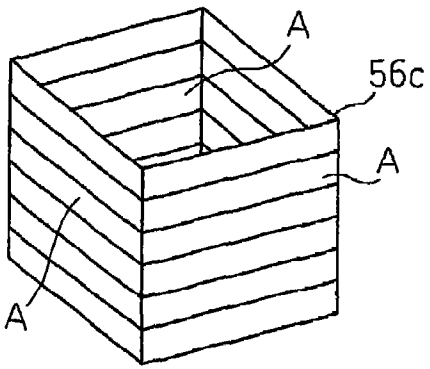
FIG. 16D is a schematic illustration showing an example of a square cylindrical body of a magnetic shield unit of another embodiment of the present invention.
Figure 16A:
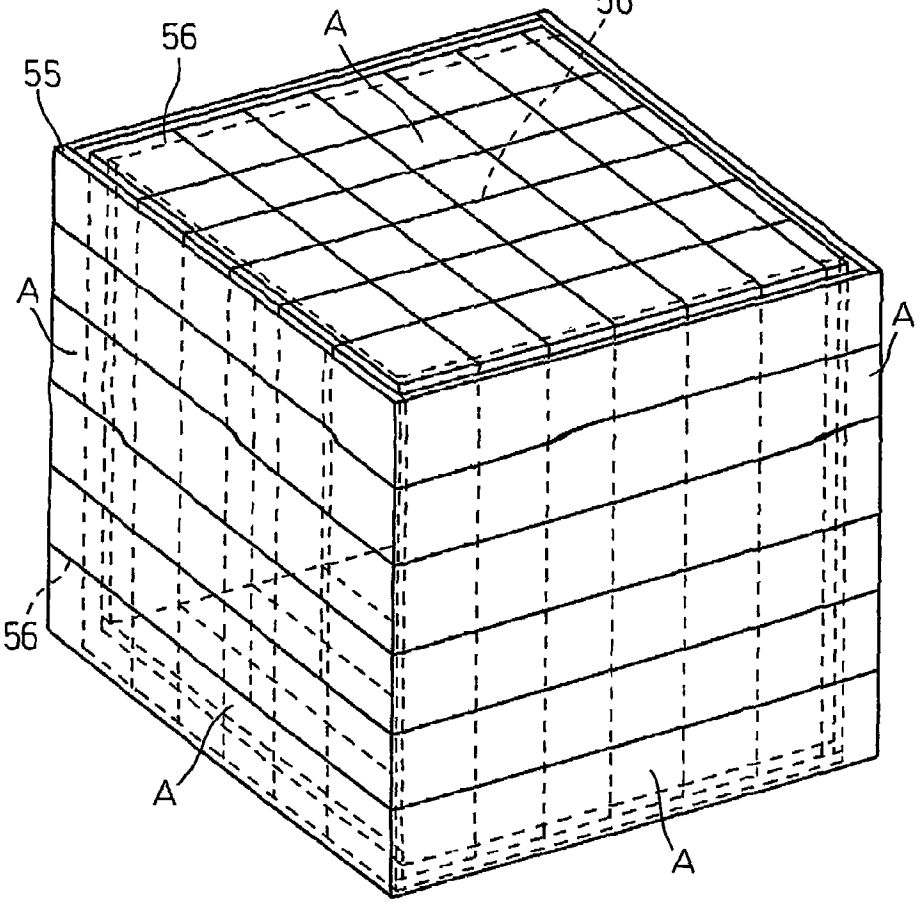
FIG. 16A is a schematic illustration showing an example of a magnetic shield unit of another embodiment of the present invention.

In the above embodiment, the magnetic shield room is composed in such a manner that two wall faces are respectively formed out of the magnetic shield panels A. However, all the six faces including the ceiling face 10, the floor face 11 and the four wall faces 12 may be composed of the magnetic shield panels A of the present invention. In this case, the magnetic shield unit 55 shown in FIG. 16A is used. As shown in FIGS. 16B, 16C, 16D, the magnetic shield unit 55 has three hollow square cylindrical bodies 56*a*, 56*b*, 56*c* having an opening portion at both end portions. Four faces of each of the square cylindrical bodies 56*a*, 56*b*, 56*c* are formed out of a plurality of magnetic shield panels A which are long in the circumferential direction. Sizes of the three square cylindrical bodies 56*a*, 56*b*, 56*c* are different from each other. As shown in FIGS. 16B, 16C, 16D, the three square cylindrical bodies 56*a*, 56*b*, 56*c* are directed in three different directions meeting at right angles with each other and combined with the insert. In the magnetic shield unit 55, the perpendicular and the horizontal magnetic shield panel A are arranged before and behind. Due to the foregoing, not only the magnetic fields in the vertical and the horizontal direction but also the magnetic fields in all directions can be shielded.

Figure 17:
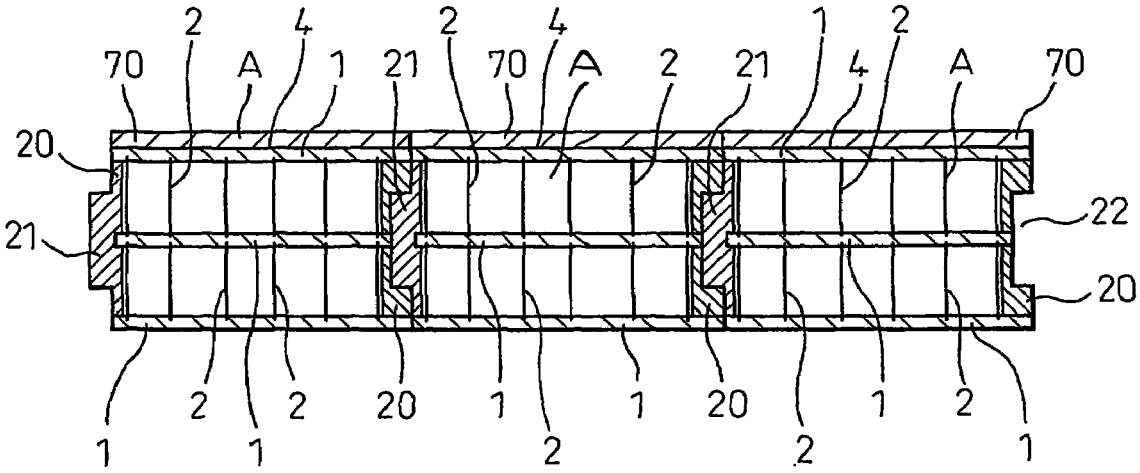
FIG. 17 is a sectional view of a magnetic shield panel of another embodiment of the present invention.

In the embodiment described before, it is explained that the magnetic shield panel A includes a pair of plate members 1. However, it should be noted that the present invention is not limited to the above specific embodiment. For example, the magnetic shield panel A may be composed when the magnetic shield member 2 is provided on one plate member 1. Further, on the magnetic shield panel A of the present embodiment, it is possible to use not less than three plate members 1. For example, as shown in FIG. 17, when a plurality of magnetic shield members 2 are arranged on three plate members 1 which are arranged being opposed to each other, the magnetic shield panel A can be composed. In this case, the plate member 1 arranged at the center is mainly used as a reinforcing plate.

Figure 18:
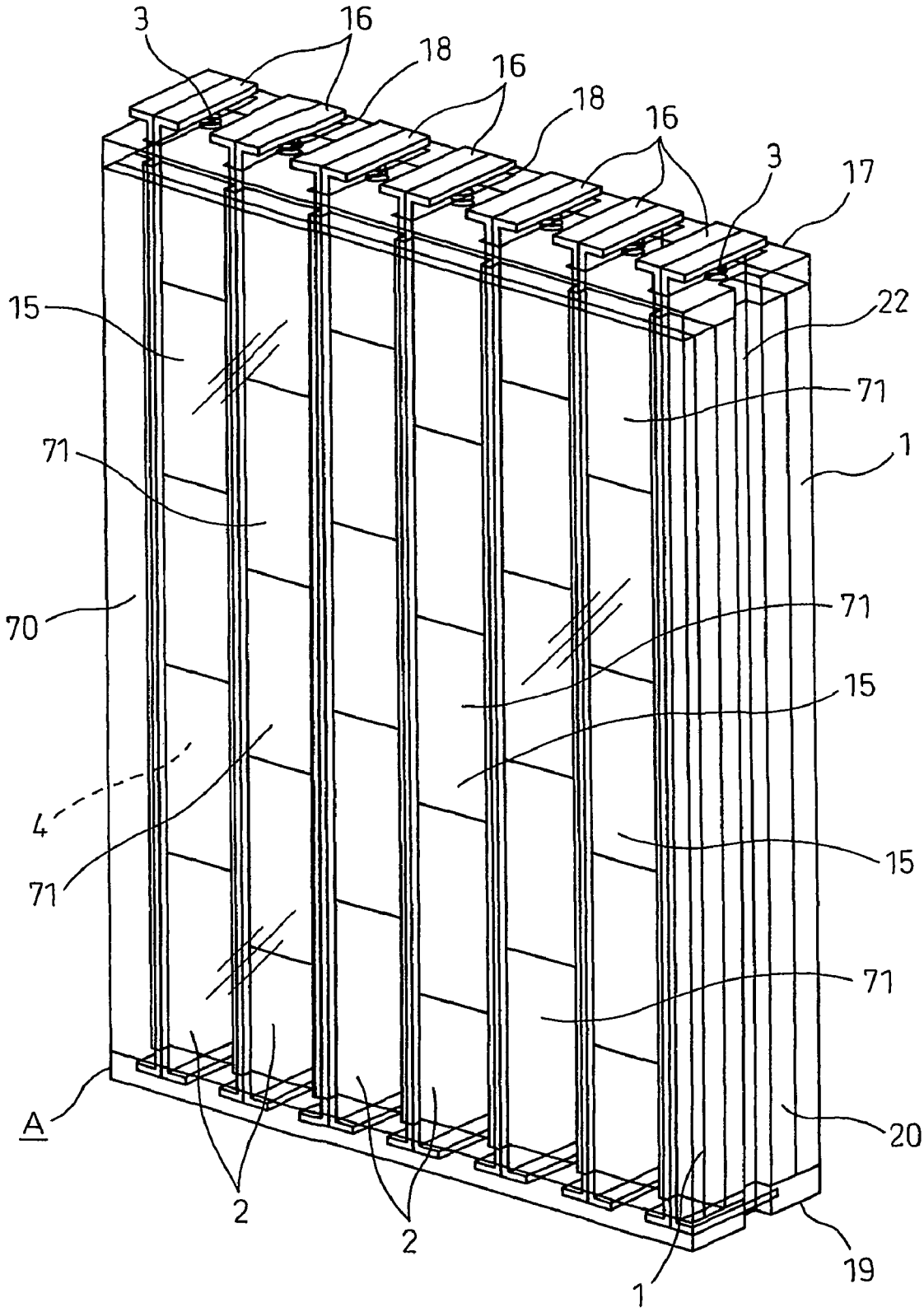
FIG. 18 is a perspective view showing a variation of the magnetic shield panel shown in FIG. 1.
Figure 19:
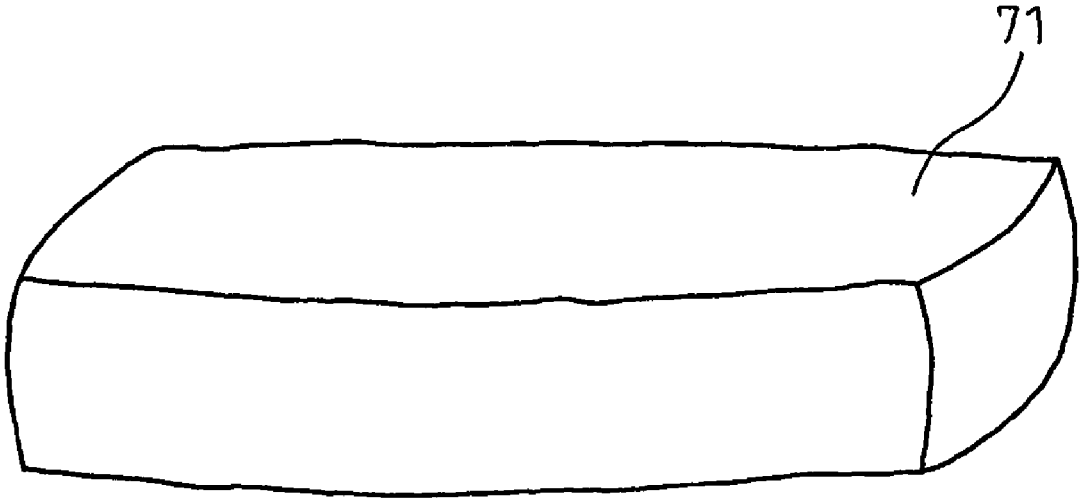
FIG. 19 is a perspective view of a heat insulating member used for the magnetic shield panel shown in FIG. 18.

Next, referring to FIGS. 18 and 19, still another embodiment of the present invention will be explained below.

In this embodiment, the translucent heat insulating member 71 is accommodated inside the magnetic shield panel A. For example, as shown in FIG. 19, the heat insulating member 71 can be formed into a rectangular parallelepiped. Concerning the translucent property of the heat insulating member 71, the heat insulating member 71 may be completely transparent or opaque in the same manner as that of the plate member 1. The heat insulating member 71 is composed of a hollow member made of elastomer such as natural rubber or synthetic rubber. Alternatively, the heat insulating member 71 is composed of a hollow member made of synthetic resin such as polyethylene, polypropylene, polyvinyl chloride (PVC) or urethane.

The heat insulating member 71 is filled between the magnetic shield members 2 adjacent to each other and bonded onto the inner face (the opposing face) of the plate member 1 by adhesive. When the magnetic shield member 2 and the heat insulating member 71 are tightly contacted with each other, the magnetic shield member 2 can be interposed between the heat insulating members 71, which are adjacent to each other, and held at a predetermined position.

Still another embodiment of the present invention will be explained below.

Figure 21:
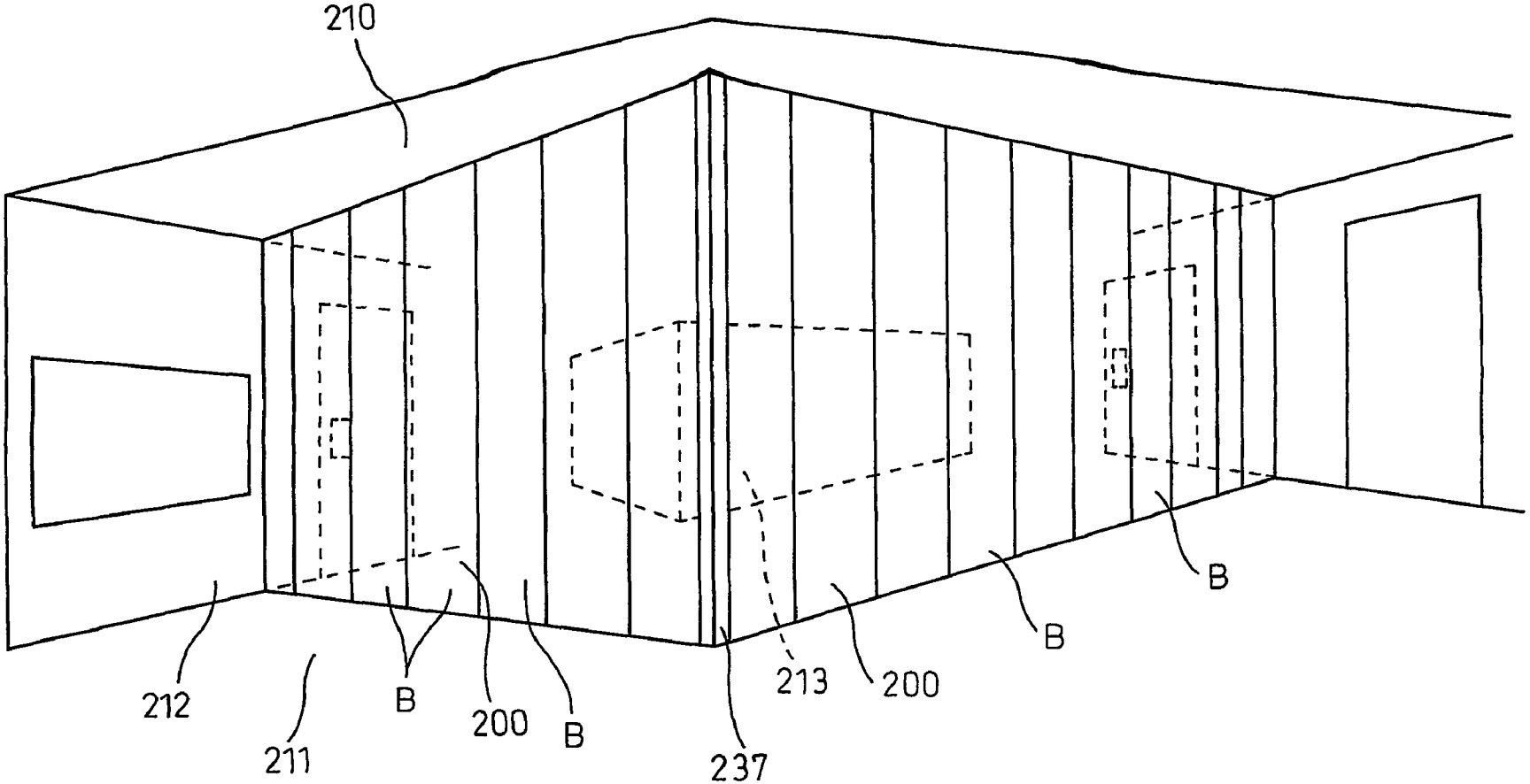
FIG. 21 is a schematic illustration showing a magnetic shield member in which the magnetic shield panel shown in FIG. 20 is used.

FIG. 21 is a view showing an example of the magnetic shield room of the present embodiment. In the same manner as that of the embodiment shown in FIG. 2, in this magnetic shield room, two wall faces among the ceiling face 210, the floor face 211 and the four wall faces 212 are formed out of the magnetic shield panels B of the present embodiment. In the present embodiment, the magnetic shield panel B is a vertical type magnetic shield panel B on which the magnetic shield member 202 is perpendicularly formed, that is, the magnetic shield member 202 is formed in the vertical direction. In this embodiment, the longitudinal direction of the magnetic shield member 202 may be set in any direction. For example, the longitudinal direction of the magnetic shield member 202 can be set in the direction parallel to the direction of the magnetic field to be shielded. In the magnetic shield room shown in FIG. 21, the direction of the magnetic field, which is generated from the magnetism generation source 213 such as MRI apparatus arranged in the room, is in the vertical direction. In order to shield this magnetic field, the vertical type magnetic shield panel B is used. However, the present invention is not limited to the above specific embodiment. In this connection, the ceiling face 210, the floor face 211 and other wall faces 212, which are not composed of the magnetic shield panel B, can be composed when flat-plate-shaped magnetic shield members are put on each other in the same manner as the conventional manner, and their surfaces can be covered with metallic foil such as copper foil or mesh made of stainless steel so as to give the radio wave shielding property to the magnetic shield panel.

Figure 20:
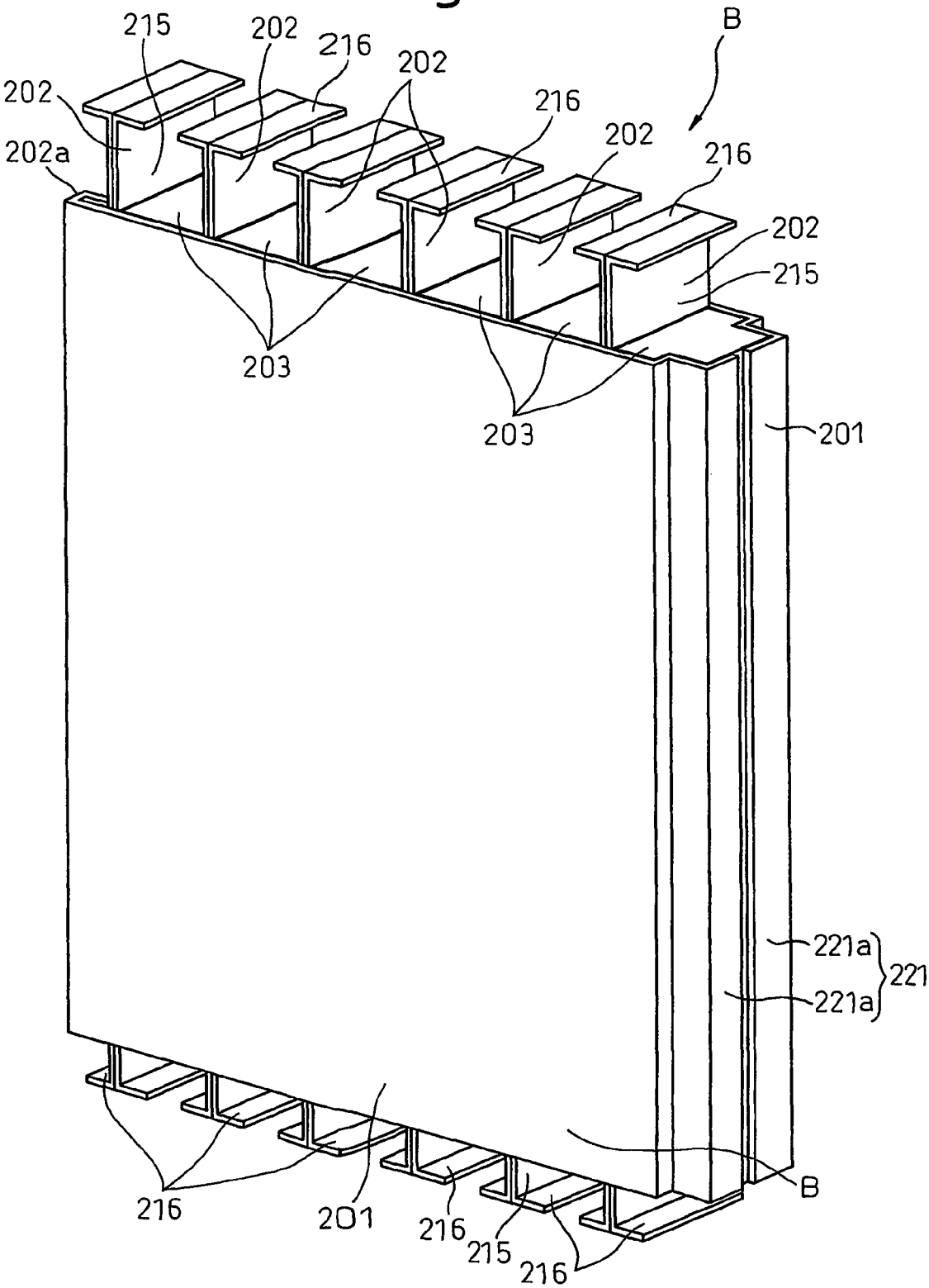
FIG. 20 is a perspective view showing another embodiment of the magnetic shield panel of the present invention.

Referring to FIG. 20, the magnetic shield panel B includes: a pair of metallic plates 201 arranged in parallel to each other being separate from each other; a plurality of magnetic shield members 202 formed in the same manner as that of the magnetic shield member 2 explained referring to FIGS. 3A and 3B; and a heat insulating member 203 arranged on the magnetic shield panel B. Concerning the metallic plate 201, as long as the thickness of the metallic plate is 0.25 to 1.6 mm so that the rigidity of the panel can be ensured and as long as the metallic plate has a radio wave shielding property for shielding electromagnetic waves, the frequency of which is 10 kHz to 40 GHz, any material can be adopted. Examples of the metallic plate 201 are: an iron plate, a steel plate, a stainless steel plate, a coated plate, a galvanized steel plate, an aluminum-galvanized steel plate, and a flat plate of aluminum.

Especially, it is preferable that the metallic plate 201 is made of a highly electrically conductive material such as iron, copper or aluminum. The performance of the magnetic shield, which is disclosed in the official gazette of Japanese Unexamined Patent Publication No. 2002-164686, with respect to AC is inferior compared with the performance of the magnetic shield with respect to DC. However, when the metallic plate 201 is made of the above materials, the performance with respect to AC can be enhanced by the effect of shielding an eddy current. The metallic plate 201 may be a perforated metallic plate such as a punching metal. The size of this metallic plate can be an appropriate value according to a desired size of the magnetic shield panel B. For example, the size of this metallic plate can be 2384 mm length×910 mm width. However, the size of this metallic plate in not limited to this specific embodiment.

The heat insulating member 203 may be made of a conventionally used heat insulating material. Examples of the heat insulating material are: inorganic fiber such as rock fiber, glass fiber or ceramic fiber; and foamed resin such as urethane foam or phenol foam. It is preferable that rock fiber or glass fiber, the heat insulating performance and the fire resistance performance of which are high, is used for the heat insulating member 203. The heat insulating member 203 can be formed into a block shape like a square bar. The density of the heat insulating member 203 is usually 20 to 400 kg/m$^3$. However, it is preferable that the density of the heat insulating member 203 is 120 to 200 kg/m$^3$.

The magnetic shield panel B can be composed in such a manner that a plurality of magnetic shield members 202 and heat insulating members 203 are provided between a pair of metallic plates 201. That is, as shown in FIG. 20, The magnetic shield panel B can be formed when a plurality of magnetic shield members 202 and heat insulating members 203 are interposed between a pair of metallic plates 201 which are arranged in parallel being opposed to each other. The magnetic shield members 202 are arranged, being separate from each other, at predetermined intervals between the pair of metallic plate members 201 so that the plane portions (the faces of the largest area) of the flat plate portions 215 can be opposed to each other. Even in the case of the magnetic shield panel B, it is preferable that the expression (1) described before is satisfied.

Figure 30:
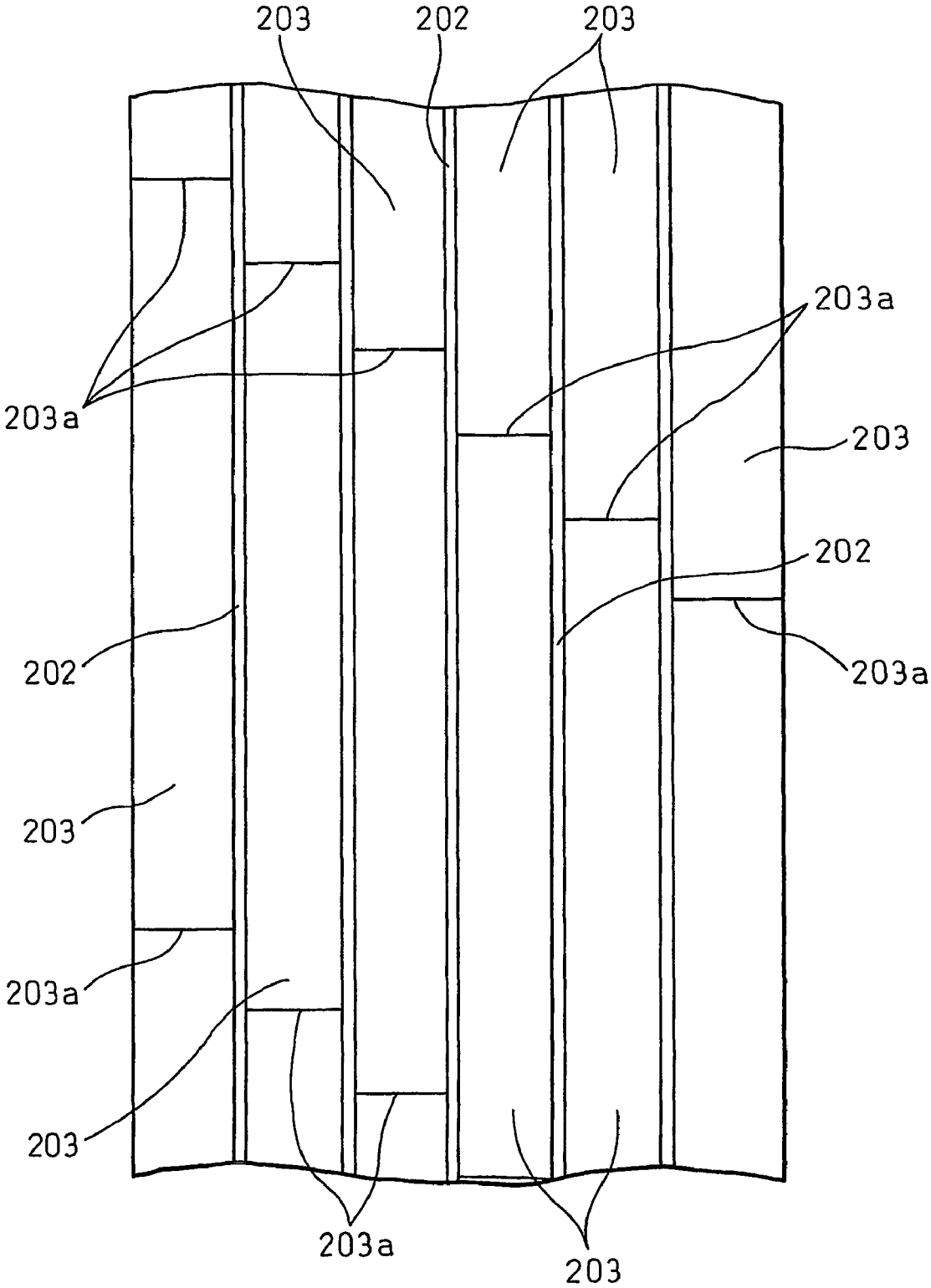
FIG. 30 is a schematic illustration showing an arrangement of the heat insulating member used for the magnetic shield panels in FIGS. 20, 29A and 29B.

In the present embodiment, the heat insulating member 203 is filled between the magnetic shield members 202 on the magnetic shield panel B and bonded on the inner faces (the faces opposed to each other) of the metallic plates 201. As shown in FIG. 30, a plurality of heat insulating members 203 are arranged zigzag on the magnetic shield panel B so that the seam joints 203*a* can not be arranged on a straight line. This structure is preferable from the viewpoint of ensuring the mechanical strength of the magnetic shield panel B.

In this embodiment, the magnetic shield member 202 is not fixed to the metallic plate 201 in the same manner as that of the magnetic shield member 2 of the embodiment described before. Therefore, the magnetic shield member 202 can be moved in the longitudinal direction (the perpendicular direction). The magnetic shield member 202 is pinched from both sides by the heat insulating members 203 substantially all over the length. Accordingly, there is no possibility that the magnetic shield member 202 is bent and deformed at the middle portion. Therefore, deterioration of the magnetic shielding property of the magnetic shield panel B can be prevented.

Figure 23:
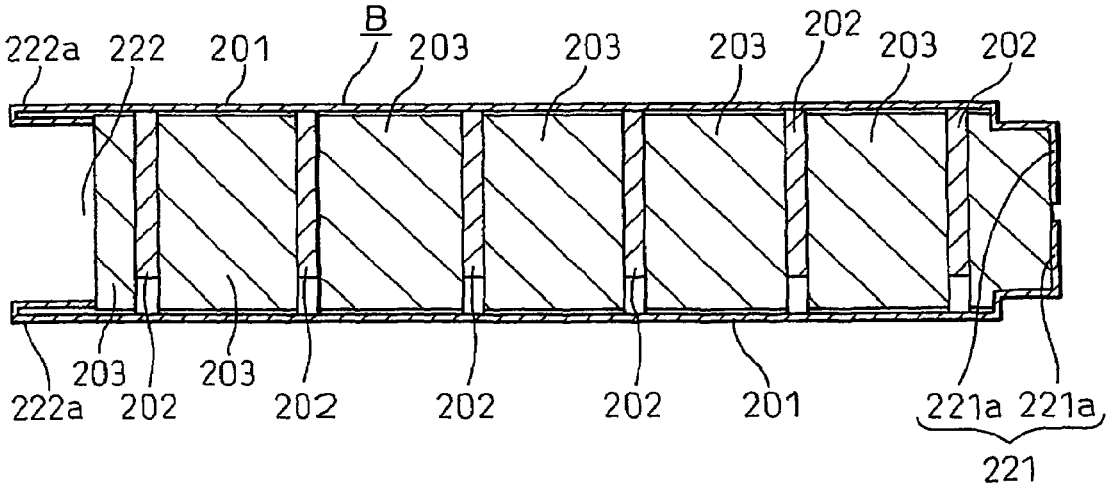
FIG. 23 is a sectional view showing a variation of the magnetic shield panel shown in FIG. 20.

As shown in FIG. 23, when the side edge of the magnetic shield member 202 is separated from the inner face of the metallic plate 201 by a predetermined distance, preferably by the distance of 3 to 10 mm, and when the magnetic shield member 202 is held by the heat insulating member 203, the occurrence of a so-called heat bridge can be prevented in which heat is conducted from one metallic plate 201 to the other metallic plate 201 via the magnetic shield member 202.

In the case where the heat insulating member 203 is made of fiber such as rock fiber, it is preferable that the fiber is mainly directed in the thickness direction (the direction perpendicular to the surface of the metallic plate 201) of the magnetic shield panel B. Due to the foregoing, deterioration of the mechanical strength of the magnetic shield panel B can be prevented.

Figure 22:
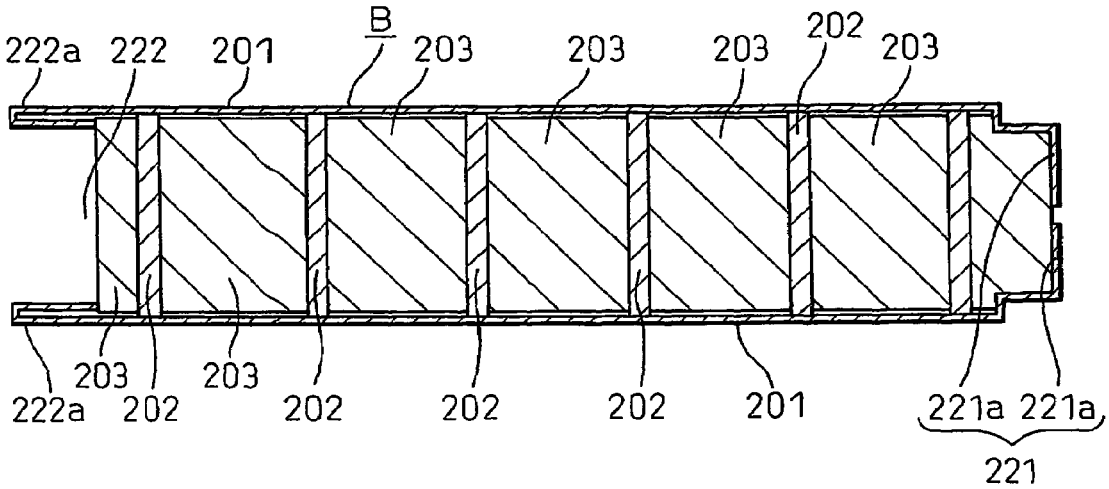
FIG. 22 is a sectional view showing the magnetic shield panel shown in FIG. 20.

The magnetic shield panel B of the present embodiment includes: an engaging protruding portion 221 formed in one side edge portion; and an engaging recess portion 222 formed in the other side edge portion. As shown in FIGS. 22 and 23, the engaging protruding portion 221 is formed when the protruding portion side protruding piece 221*a* formed by bending one side edge portion of the metallic plate 201 is arranged being opposed under the interposition of the heat insulating member 203. The engaging recess portion 222 is formed when the recess portion side protruding piece 222*a*, which is formed by bending the side edge portion on the opposite side to the protruding piece 221*a* on the metallic plate 201, is arranged being opposed under the interposition of the heat insulating member 203. Accordingly, the side of the heat insulating member 203 provided between the metallic plates 201 is covered with the protruding portion side protruding piece 221*a* and the recess portion side protruding piece 222*a*.

The magnetic shield member 202 is arranged between a pair of metallic plates 201 so that the engaging portion 216 of the magnetic shield member 202 can be protruded from an upper end and a lower end of the metallic plate 201. An upper face and a lower face of the heat insulating member 203 are exposed from between the pair of metallic plates 201.

When construction is conducted in such a manner that a plurality of vertical type magnetic shield panels B are arranged in the substantially horizontal direction, the magnetic shield room shown in FIG. 21 can be composed. This magnetic shield room can also shield radio waves by the metallic plates 201.

In the substantially same manner as that of the embodiment explained referring to FIGS. 5A and 5B, the magnetic shield panel B of this embodiment can be fixed to the ceiling structural member and the floor structural member of a building by the fixing fixture such as bolts.

Figure 24A:
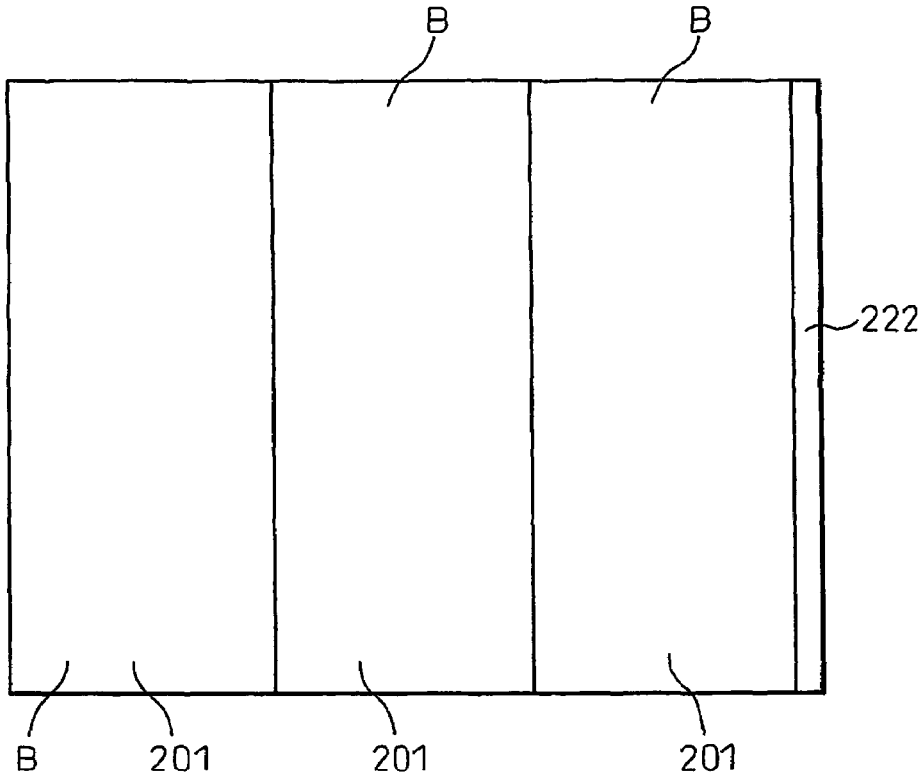
FIG. 24A is a front view briefly showing a plurality of magnetic shield panels connected to each other.
Figure 24B:
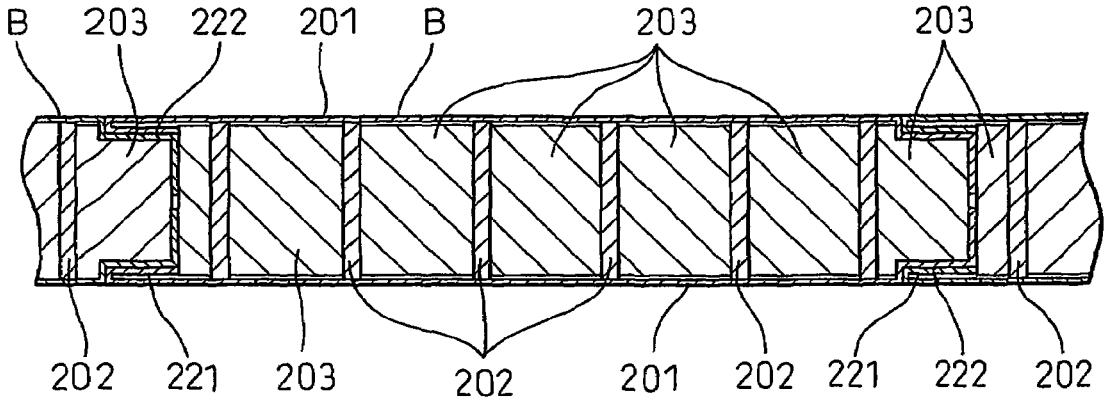
FIG. 24B is a sectional view showing a plurality of magnetic shield panels connected to each other.

As shown in FIGS. 24A and 24B, the magnetic shield panels B, which are adjacent to each other in the horizontal direction (the lateral direction), are connected to each other by the engagement of the engaging protruding portion 221 with the engaging recess portion 222. In the engaging protruding portion 221 with the engaging recess portion 222, it is preferable that coating on the metallic plates 201 of the magnetic shield panel B is peeled off. Due to the foregoing, by the engagement of the engaging protruding portion 221 with the engaging recess portion 222, the metallic plate 201 on the magnetic shield panel B is electrically connected to the metallic plate 201 on the adjoining magnetic shield panel B. Therefore, the radio waves absorbed by the metallic plate 201 are diffused to a large number of metallic plates 201, and the radio wave shielding performance can be enhanced.

Figure 25:
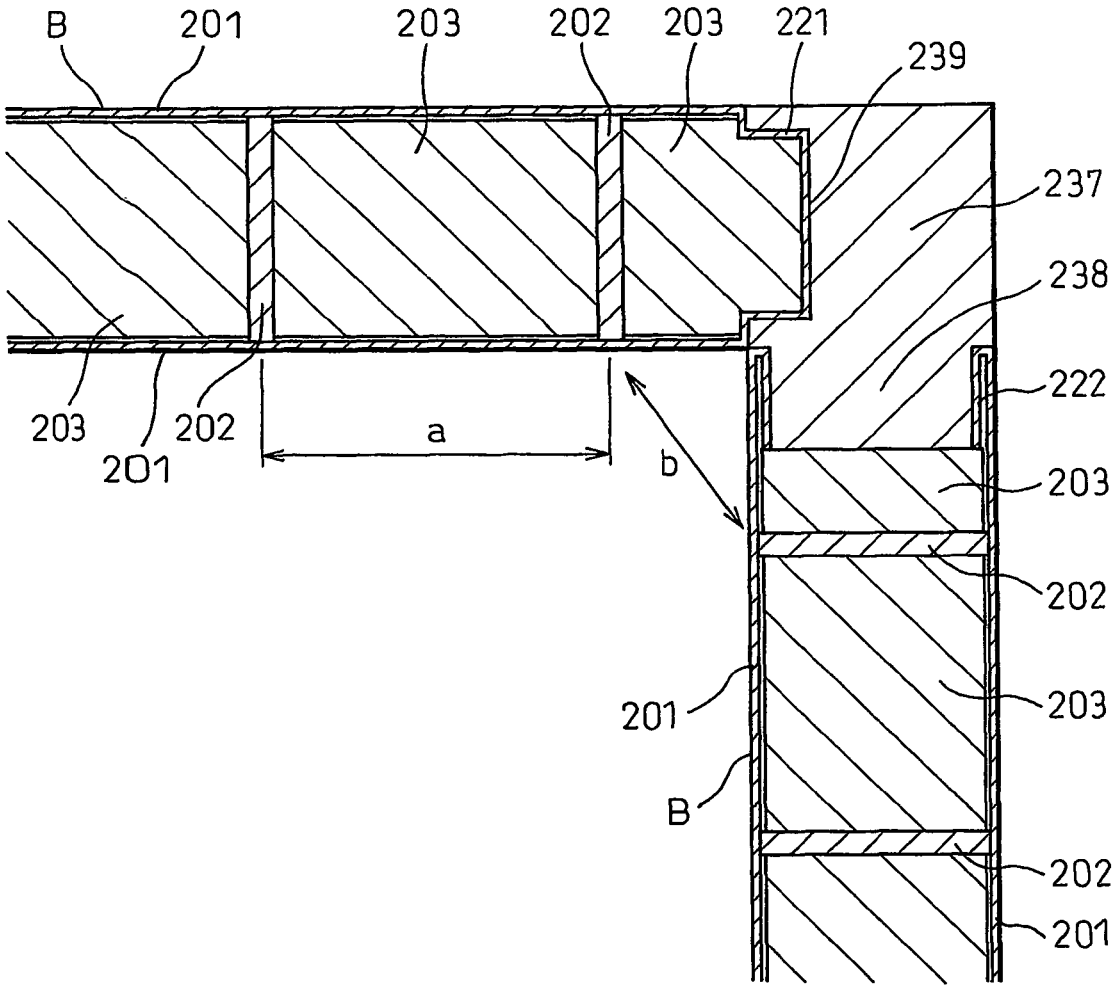
FIG. 25 is a partial sectional view showing a corner portion formed by two magnetic shield panels connected to each other at a right angle.

As shown in FIG. 25, at the corner portion of the magnetic shield room, the magnetic shield panels B, which are arranged being directed at a right angle, are connected to each other via the pillar member 237. In this case, the engaging protrusion 238 is formed on one side of the pillar member 237. This engaging protrusion 238 is engaged with the engaging recess 222 of the magnetic shield panel B. On the other side of the pillar member 237, the engaging recess 239 is formed. This engaging recess 239 is engaged with the engaging protrusion 221 of the magnetic shield panel B.

On the two magnetic shield panels B which are adjacent and connected to each other via the pillar member 237, it is preferable that the distance "b" between the magnetic shield members 202, which are located at the closest positions to the pillar member 237, is smaller than the interval "a" of the magnetic shield members 202 arranged between the metallic plate members 201 of one magnetic shield panel B. Due to the foregoing, deterioration of the magnetic shielding property of the magnetic shield member can be prevented. Concerning the magnetic shield room, a portion or all of at least one face of the ceiling face 210, the floor face 211 and the wall face 212 can be composed of the above magnetic shield panel B.

Figure 26A:
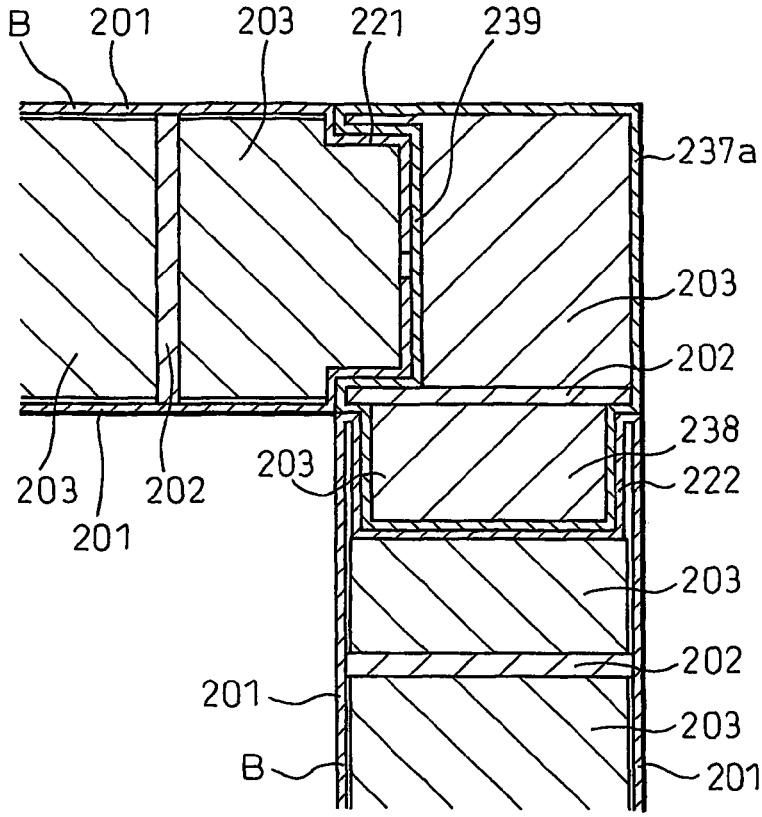
FIG. 26A is a partial sectional view showing a corner portion formed by two magnetic shield panels connected to each other at a right angle of another embodiment.

As shown in FIGS. 26A. 26B, it is possible to use a pillar member 237 into which the magnetic shield member 202 is incorporated. This pillar member 237 is composed in such a manner that the magnetic shield member 202 is arranged in the hollow pillar outline member 237*a*, which is long in the perpendicular direction, and the heat insulating member 203 is filled inside the pillar outline member 237*a*. The outer shape of the pillar outline member 237*a* is the same as that of the solid pillar member shown in FIG. 25.

Figure 26B:
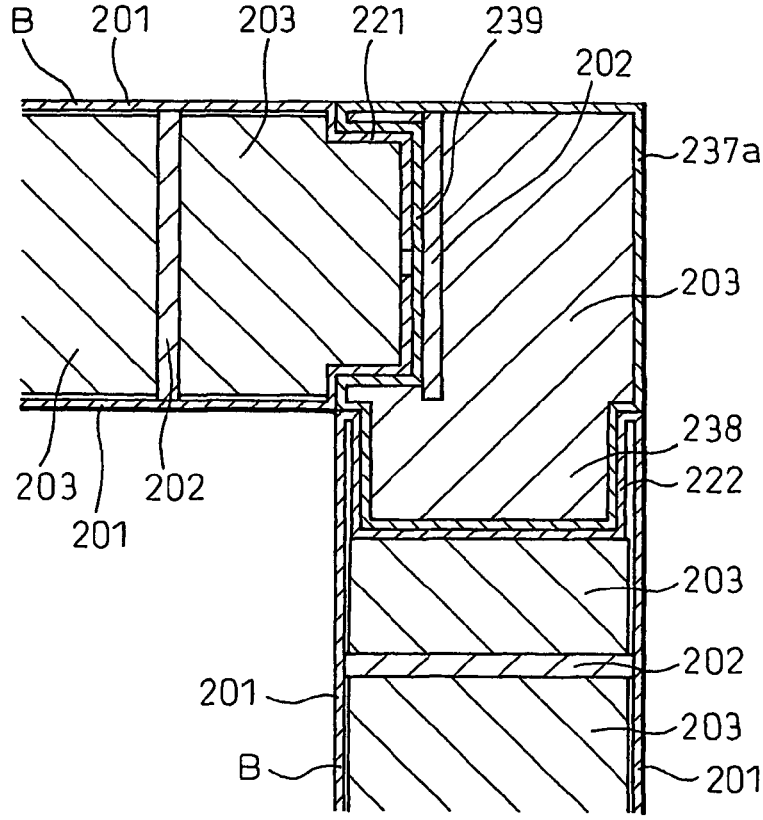
FIG. 26B is a partial sectional view showing a corner portion formed by two magnetic shield panels connected to each other at a right angle of still another embodiment.

The pillar outline member 237*a* can be formed by bending the same metallic plate as the metallic plate 201. The engaging recess portion 239 and the engaging protruding portion 238 can be formed by means of folding. The magnetic shield member 202 is accommodated inside the pillar outline member 237*a* all over the length in the perpendicular direction. As shown in FIG. 26A, the magnetic shield member 202 can be arranged inside the engaging protruding portion 238. Alternatively, as shown in FIG. 26B, the magnetic shield member 202 can be arranged inside the engaging recess portion 239. In the embodiments shown in FIGS. 26A and 26B, directions of the magnetic shield members 202 are different from each other by about 90°. However, in either embodiment, the magnetic shield member 202 of one of the two magnetic shield panels B connected to the pillar member 237 is opposed to the flat plate portion of the magnetic shield member 202. When the magnetic shield member 202 is provided in the pillar member 237 as described above, the magnetic shielding performance in the pillar member 237 can not be lowered.

Figure 27:
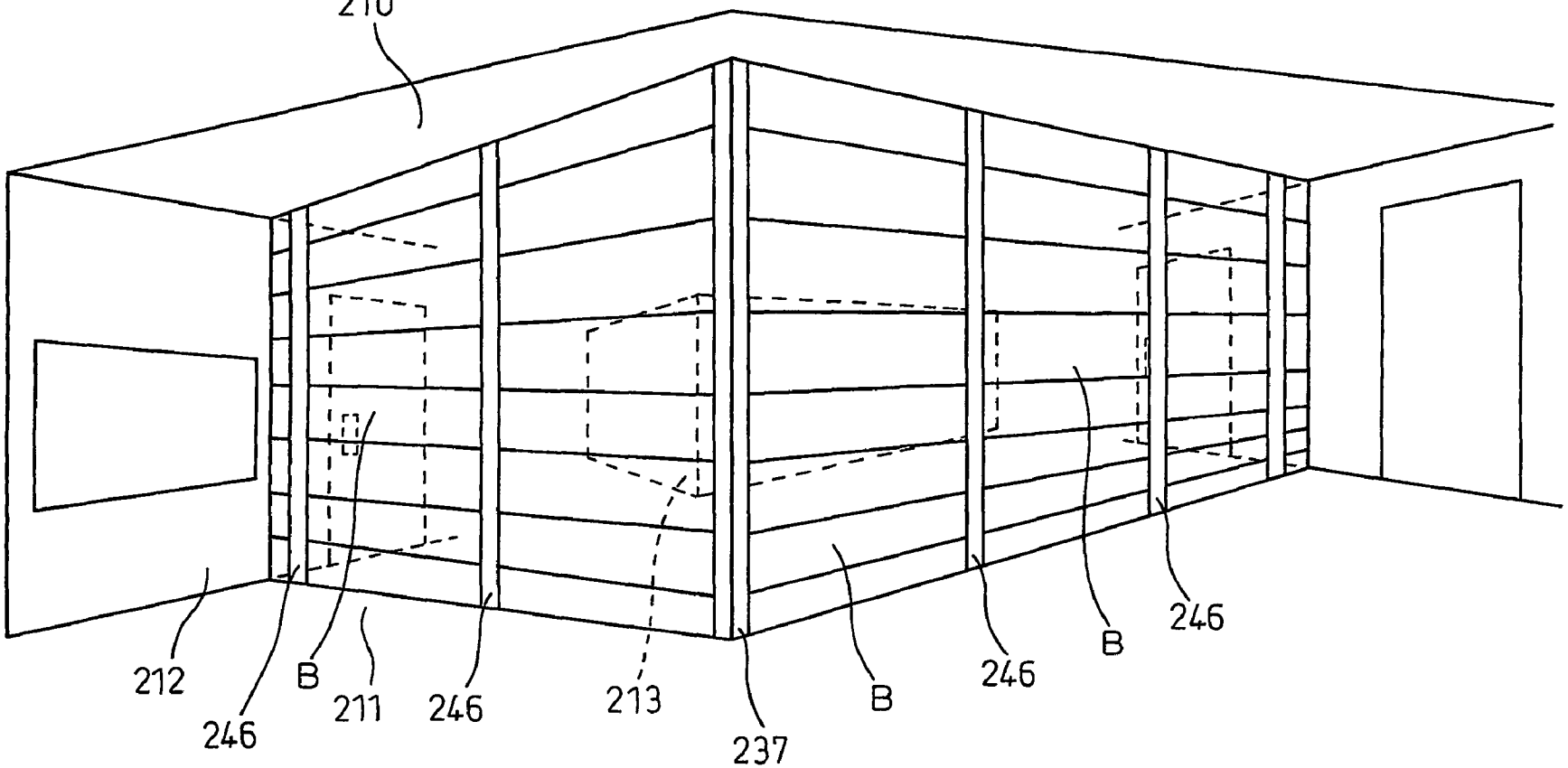
FIG. 27 is a schematic illustration briefly showing a magnetic shield room formed by a horizontal type magnetic shield panel.

FIG. 27 is a view showing another embodiment of the magnetic shield room of the present invention.

In the same manner as that of the embodiment explained referring to FIG. 13, concerning this magnetic shield room, two wall faces out of the ceiling face 210, the floor face 211 and four wall faces 212 are composed of the magnetic shield panels B of the present embodiment. In this embodiment, the magnetic shield panel B is a horizontal type magnetic shield panel B on which the magnetic shield member 202 is formed horizontally, that is, the magnetic shield member 202 is formed in the horizontal direction.

The horizontal type magnetic shield panel B includes a pair of metallic plates 201, a magnetic shield member 202 and a heat insulating member 203. The horizontal type magnetic shield panel B can be substantially composed in the same manner as that of the vertical type magnetic shield panel B except that the magnetic shield member 202 is formed into a rectangular plate shape, which is long in the horizontal direction, and not provided with the engaging portion 216. The metallic plate 201 is substantially composed in the same manner as that of the metallic plate of the vertical type magnetic shield panel B except that the longitudinal direction of the metallic plate 201 is substantially horizontal.

Between a pair of metallic plates 201 arranged being opposed to each other, a plurality of magnetic shield members 202 and the heat insulating member 203 are arranged. The magnetic shield members 202 are arranged between the pair of metallic plates 201 so that the magnetic shield members 202 can be perpendicularly directed to the metallic plates 201. In this case, even in the case of the horizontal type magnetic shield panel B, it is preferable that the expression (1) is satisfied. When this condition is satisfied, the magnetic shielding property can be effectively obtained.

In the case of the horizontal type magnetic shield panel B, the magnetic shield panels B, which are adjacent to each other on the upper and lower sides, are connected to each other by the engagement of the engaging protrusion with the engaging recess in the same manner as the case in which the vertical type magnetic shield panels B are connected to each other in the horizontal direction. Shapes of the engaging protrusion and the engaging recess of the magnetic shield panels B are the same as those of the case shown in FIG. 20. An end face of the heat insulating member 203 provided between a pair of metallic plates 201 is exposed from the opening of the end faces of the magnetic shield panels B. The forward end portion 240 of the magnetic shield member 202 is protruded from the opening of this end face.

In the case of the horizontal type magnetic shield panel B, the magnetic shield member 202 is not fixed to the metallic plate member 201. Therefore, the magnetic shield member 202 can be moved in the horizontal direction. Accordingly, there is a possibility that an intermediate portion of the magnetic shield member 202 is bent and deformed. However, as described above, when the magnetic shield member 202 is interposed between the heat insulating members 203 adjacent to each other, deflection of the magnetic shield member 202 can be prevented. Therefore, deterioration of the magnetic shielding performance of the magnetic shield panel B can be prevented.

In the same manner as that of the embodiment explained before referring to FIG. 13, when construction is conducted by arranging a plurality of horizontal type magnetic shield panels B in the vertical and horizontal directions, the magnetic shield room shown in FIG. 27 can be formed. This magnetic shield room is also capable of shielding radio waves by the metallic plate 201.

Figure 28A:
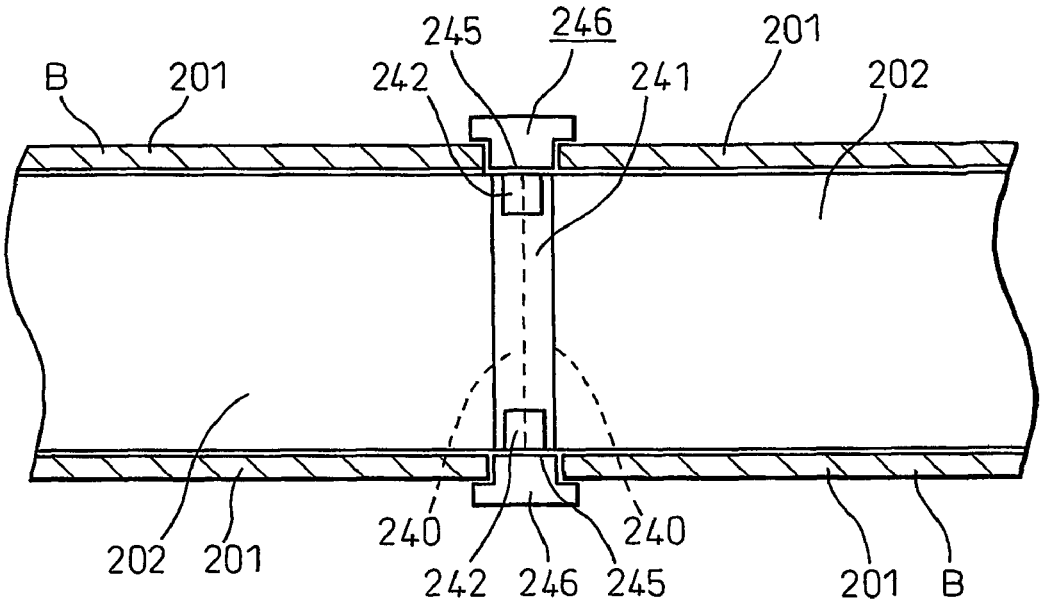
FIG. 28A is a partial sectional view showing a magnetic shield panel forming the magnetic shield room shown in FIG. 27.
Figure 28B:
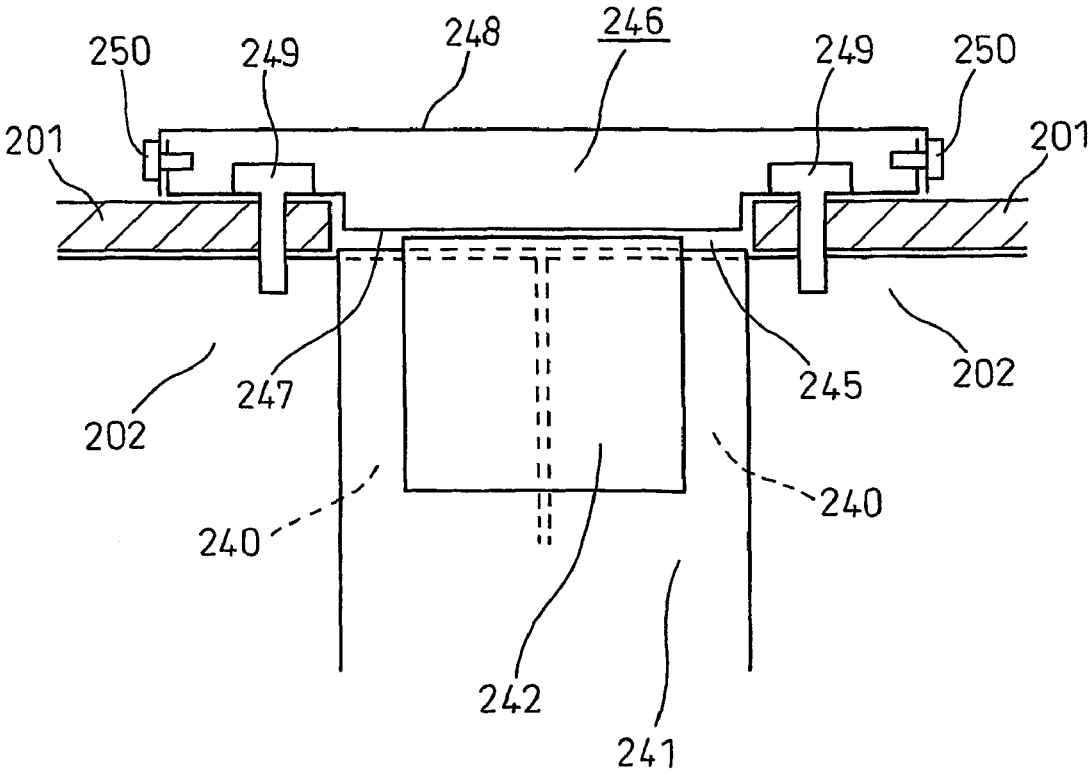
FIG. 28B is an enlarged view of FIG. 28A.

The horizontal type magnetic shield panels B are applied substantially in the same manner as that of the vertical type magnetic shield panels B. The magnetic shield panels B, which are located at the uppermost and the lowermost position, are respectively fixed to the ceiling structural member 25 and the floor structural member 27 (FIGS. 5A and 5B), and the magnetic shield panels B adjacent to each other in the horizontal direction are connected with each other by the accessory 246. That is, as shown in FIGS. 28A and 28B, on the front and the reverse face of the horizontal type magnetic shield panels B, the joint (the gap) 245 is formed between the edge portions of a pair of metallic plate members 201. The accessory 246, the cross section of which is a substantially T-shape, is arranged in this joint 245. The magnetic shield panels B can be fixed by this accessory 246. The accessory 246 can be a molding made of metal such as aluminum, however, other metals can be used for molding the accessory 246. The accessory 246 is provided with a base member 247 and a cover member 248. The metallic plate member 201 is attached to the base member 247 by the fixing fixture 249 such as a screw. The cover member 248 is attached to the base member 247 by the fixing fixture 50 such as a screw.

The forward end portion 240 of the magnetic shield member 202 protruding outside (on the side) of the end portion of a pair of metallic plate member 201 is adjacent to the horizontal type magnetic shield panels B adjoining in the horizontal direction. As explained below referring to FIGS. 15A, 15B and 15C, the forward end portions 240 are connected to each other.

Figure 29A:
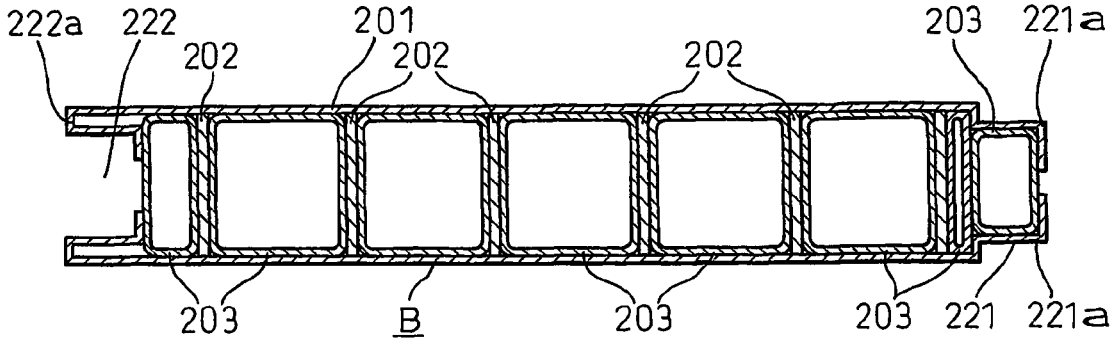
FIG. 29A is a sectional view showing a variation of the magnetic shield panel shown in FIG. 20.
Figure 29B:
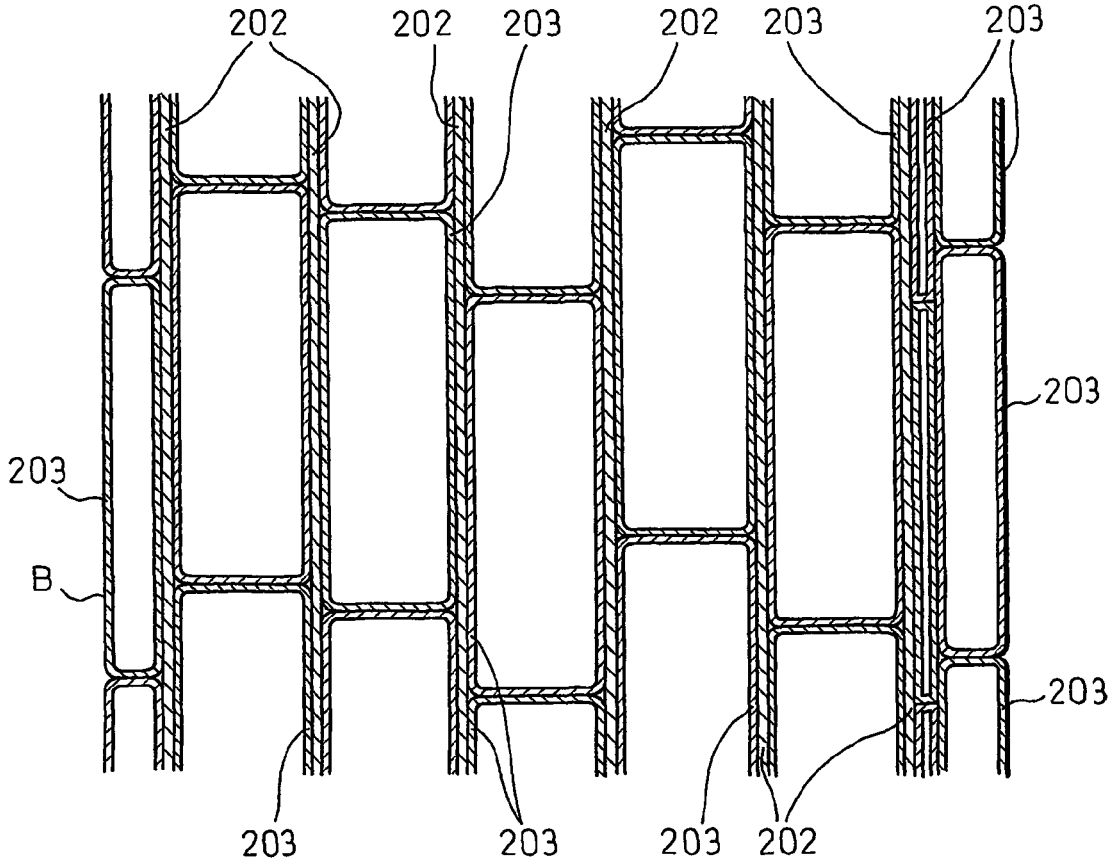
FIG. 29B is a sectional view taken in a different direction from FIG. 29A.

Next, another embodiment is shown in FIGS. 29A and 29B.

On the magnetic shield panel B of this embodiment, the heat insulating member 203 is formed into a hollow body. Other points of the constitution are the same as those of the embodiment explained referring to FIGS. 20 to 28. For example, as shown in FIG. 19, the hollow heat insulating member 203 can be formed into a rectangular parallelepiped. The heat insulating member 203 is composed of a hollow member made of elastomer such as natural rubber or synthetic rubber. Alternatively, the heat insulating member 71 is composed of a hollow member made of synthetic resin such as polyethylene, polypropylene, polyvinyl chloride (PVC) or urethane. The heat insulating member 203 may be translucent or opaque.

The heat insulating member 203 is filled between the magnetic shield members 202 adjacent to each other and bonded onto the inner face (the opposing face) of the metallic plate 201 by adhesive. When the magnetic shield member 202 and the heat insulating member 203 are tightly contacted with each other, the magnetic shield member 202 can be interposed between the heat insulating members 203, which are adjacent to each other, and held at a predetermined position. When the hollow heat insulating member 203 is used as described above, the weight of the magnetic shield panel B can be reduced as compared with the case in which the solid heat insulating member 203 is used. When it is necessary to enhance the rigidity of the magnetic shield panel B, the heat insulating member 203, the rigidity of which is relatively high, is used.

Figure 31:
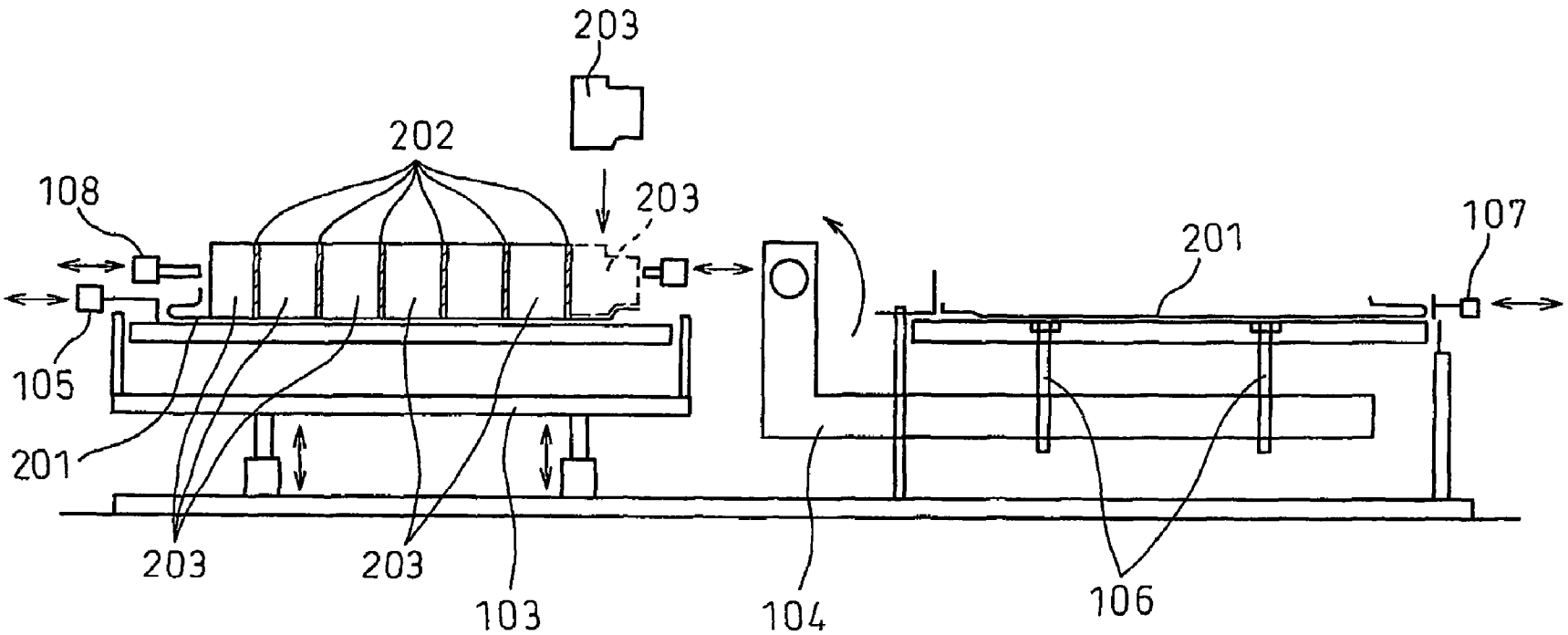
FIG. 31 is a schematic illustration showing an example of the manufacturing device of manufacturing the magnetic shield panel shown in FIGS. 20, 29A and 29B.

Next, referring to FIG. 31, a method of manufacturing the magnetic shield panel B will be explained below.

First, the heat insulating members 203 and the magnetic shield members 202 are arranged at predetermined positions on the metallic plate 201. In order to arranged the heat insulating members 203 and the magnetic shield members 202 on the metallic plate 201, the heat insulating members 203 and the magnetic shield members 202 can be alternately arranged on the metallic plate 201. Alternatively, a unit is made by alternately arranging the heat insulating members 203 and the magnetic shield members 202, and the thus made unit can be put on the metallic plate 201.

The metallic plate 201, on which the heat insulating members 203 and the magnetic shield members 202 are arranged, is held on the elevating holding device 103. Next, the other metallic plate 201 is reversed by the reversal device 104 and put on the heat insulating members 203 arranged on the metallic plate 201 which is held on the elevating holding device 103. In this case, the metallic plate 201 to be reversed is coated with adhesive. In this way, the heat insulating members 203 and the magnetic shield members 202 can be arranged between the pair of metallic plates 201.

In this connection, the heat insulating members 203 and the magnetic shield members 202 may be arranged on the metallic plate 201 under the condition that the metallic plate 201 is held on the elevating holding device 103. Alternatively, the heat insulating members 203 and the magnetic shield members 202 may be arranged on the metallic plate 201 under the condition that the metallic plate 201 is not held on the elevating holding device 103. It is preferable that the elevating holding device 103 includes a holding fixture 105 for holding the metallic plate 201, on which the heat insulating members 203 are arranged, at a predetermined position. The reversal device 104 includes a sucking fixture 106 composed of a magnet or a vacuum suction pad. Further, there is provided a holding fixture 107 for holding the metallic plate 201 to be reversed at a predetermined position with respect to the reversal device 104. Furthermore, there is provided a compressing device 108 for pushing and compressing end portions of the heat insulating members 203 so that the metallic plate 201 can be easily put on the heat insulating members 203.

In this connection, even in the case of the magnetic shield panel B explained referring to FIGS. 20 to 29, of course, the magnetic shield room shown in FIGS. 16A to 16D can be composed by combining the vertical type magnetic shield panel B with the horizontal type magnetic shield panel B.

The invention claimed is:

1. A magnetic shield panel comprising: a plurality of magnetic shield members made of magnetic material; a translucent plate member to which each magnetic shield member is attached; and a holding member for holding the magnetic shield member so as to avoid deflection of each magnetic shield member, wherein the holding member is a translucent heat insulating member positioned close to the plurality of magnetic shield members, the translucent heat insulating member being filled between the plurality of magnetic shield members for holding the magnetic shield members so as to avoid deflection of each magnetic shield member.

2. A magnetic shield panel according to claim 1, wherein the holding member is an elastic member for stretching the magnetic shield member in the longitudinal direction thereof.

3. A magnetic shield panel according to claim 1, wherein the magnetic shield panel comprises a plurality of translucent heat insulating members, each translucent heat insulating member being formed into a rectangular parallelepiped, the plurality of heat insulating members being arranged zigzag on the magnetic shield panel so that seam joints of each heat insulating member are not arranged in a straight line.

4. A magnetic shield panel according to claim 1, further comprising a hollow pillar member for connecting a plurality of magnetic shield panels to each other, the hollow pillar member having a magnetic shield member therein.

5. A magnetic shield panel according to claim 1, further comprising a radio wave shield member made of electrically conductive material.

6. A magnetic shield panel according to claim 5, wherein the radio wave shield member is a metallic mesh attached to the translucent plate member.

7. A magnetic shield panel according to claim 1, wherein the number of the translucent plate members is not less than two.

8. A magnetic shield panel according to claim 1, wherein the magnetic shield member is arranged substantially in parallel with the direction of a magnetic field.

9. A magnetic shield panel according to claim 1, wherein engaging portions are provided at both end portions of the magnetic shield member, and the magnetic shield member is formed into a substantial Z-shape.

10. A magnetic shield panel according to claim 1, wherein engaging portions are provided at both end portions of the magnetic shield member, and the magnetic shield member is formed into a substantial I-shape.

11. A magnetic shield panel comprising: a plurality of magnetic shield members made of magnetic material; a metallic plate to which each magnetic shield member is attached; and a holding member for holding the magnetic shield member so as to avoid deflection of each magnetic shield member, wherein the holding member is a heat insulating member positioned close to the plurality of magnetic shield members, the heat insulating member being filled between the plurality of magnetic shield members for holding the magnetic shield members so as to avoid deflection of each magnetic shield member.

12. A magnetic shield panel according to claim 11, wherein the holding member is an elastic member for stretching the magnetic shield member in the longitudinal direction thereof.

13. A magnetic shield panel according to claim 11, wherein the magnetic shield panel comprises a plurality of heat insulating members, each heat insulating member being formed into a rectangular parallelepiped, the plurality of heat insulating members being arranged zigzag on the magnetic shield panel so that seam joints of each heat insulating member are not arranged on a straight line.

14. A magnetic shield panel according to claim 11, further comprising a hollow pillar member for connecting a plurality of magnetic shield panels to each other, the hollow pillar member having a magnetic shield member therein.

15. A magnetic shield panel according to claim 11, wherein the heat insulating member is made of refractory material.

16. A magnetic shield panel according to claim 11, wherein the number of the metallic plates is not less than two.

17. A magnetic shield panel according to claim 11, wherein the magnetic shield member is arranged substantially in parallel with the direction of a magnetic field.

18. A magnetic shield panel according to claim 11, wherein engaging portions are provided at both end portions of the magnetic shield member, and the magnetic shield member is formed into a substantial Z-shape.

19. A magnetic shield panel according to claim 11, wherein engaging portions are provided at both end portions of the magnetic shield member, and the magnetic shield member is formed into a substantial I-shape.

20. A magnetic shield panel according to claim 11, wherein the metallic plate is made of material selected from a group including iron, steel, copper, aluminum, stainless steel, galvanized steel and aluminum-galvanized steel.

* * * * *

UNITED STATES PATENT AND TRADEMARK OFFICE

CERTIFICATE OF CORRECTION

PATENT NO. : 7,589,285 B2
APPLICATION NO. : 10/571310
DATED : September 15, 2009
INVENTOR(S) : Matsumoto et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 113 days.

Signed and Sealed this

Twenty-first Day of September, 2010

David J. Kappos

David J. Kappos
*Director of the United States Patent and Trademark Office*